US011652272B2

(12) United States Patent
Kim et al.

(10) Patent No.: US 11,652,272 B2
(45) **Date of Patent: *May 16, 2023**

(54) CHIP ANTENNA

(71) Applicant: Samsung Electro-Mechanics Co., Ltd., Suwon-si (KR)

(72) Inventors: Jae Yeong Kim, Suwon-si (KR); Sung Nam Cho, Suwon-si (KR); Sung Yong An, Suwon-si (KR); Ji Hyung Jung, Suwon-si (KR); Chin Mo Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/499,212

(22) Filed: Oct. 12, 2021

(65) Prior Publication Data

US 2022/0029274 A1 Jan. 27, 2022

Related U.S. Application Data

(63) Continuation of application No. 16/732,762, filed on Jan. 2, 2020, now Pat. No. 11,223,100.

(30) Foreign Application Priority Data

Mar. 25, 2019 (KR) ..... 10-2019-0033918
Sep. 10, 2019 (KR) ..... 10-2019-0112303

(51) Int. Cl.
*H01Q 1/22* (2006.01)
*H01Q 9/40* (2006.01)
(Continued)

(52) U.S. Cl.
CPC ..... *H01Q 1/2283* (2013.01); *H01Q 1/38* (2013.01); *H01Q 1/48* (2013.01); *H01Q 9/0457* (2013.01); *H01Q 9/40* (2013.01); *H01Q 21/065* (2013.01)

(58) Field of Classification Search
CPC ..... H01Q 1/2283; H01Q 1/38; H01Q 1/48; H01Q 9/0457; H01Q 9/40; H01Q 21/065;
(Continued)

(56) References Cited

U.S. PATENT DOCUMENTS 6,114,998 A 9/2000 Schefte et al.
6,154,176 A 11/2000 Fathy et al.
(Continued)

FOREIGN PATENT DOCUMENTS

JP 2000-114866 A 4/2000
JP 2003-283239 A 10/2003
(Continued)

OTHER PUBLICATIONS

Korean Office Action dated Jul. 6, 2020 in corresponding Korean Patent Application No. 10-2019-0112303 (6 pages in English, 6 pages in Korean).

*Primary Examiner* — David E Lotter
(74) *Attorney, Agent, or Firm* — NSIP Law

(57) ABSTRACT

A chip antenna includes a first ceramic substrate, a second ceramic substrate disposed to face the first ceramic substrate, a first patch disposed on the first ceramic substrate to operate as a feed patch, and a second patch disposed on the second ceramic substrate to operate as a radiation patch. One or both of the first ceramic substrate and the second ceramic substrate include a groove, and one or both of the first patch and the second patch is disposed in the groove of the respective first ceramic substrate and second ceramic substrate and protrudes from the groove.

14 Claims, 20 Drawing Sheets

(51) Int. Cl.

| | |
|---|---|
| ***H01Q 9/04*** | (2006.01) |
| ***H01Q 21/06*** | (2006.01) |
| ***H01Q 1/48*** | (2006.01) |
| ***H01Q 1/38*** | (2006.01) |

(58) Field of Classification Search
CPC ..... H01Q 1/243; H01Q 5/378; H01Q 9/0435; H01Q 21/08; H01Q 21/28; H01Q 25/00; H01Q 1/36; H01Q 1/50; H01Q 19/10; H01Q 21/00; H01Q 21/06
See application file for complete search history.

(56) References Cited

U.S. PATENT DOCUMENTS

| | | | | |
|---|---|---|---|---|
| 11,223,100 | B2 * | 1/2022 | Kim ..... | H01Q 1/243 |
| 2014/0145883 | A1 | 5/2014 | Baks et al. | |
| 2019/0333882 | A1 | 10/2019 | Kamgaing et al. | |
| 2020/0335870 | A1 | 10/2020 | Kim et al. | |

FOREIGN PATENT DOCUMENTS

| | | | |
|---|---|---|---|
| JP | 2006-270850 | A | 10/2006 |
| KR | 10-2010-0112353 | A | 10/2010 |
| KR | 10-2011-0049544 | A | 5/2011 |
| KR | 10-1163419 | B1 | 7/2012 |

* cited by examiner

CHIP ANTENNA

CROSS-REFERENCE TO RELATED APPLICATIONS

This application is a continuation of U.S. patent application Ser. No. 16/732,762 filed on Jan. 2, 2020, which claims the benefit under 35 USC 119(a) of Korean Patent Application No. 10-2019-0033918 filed on Mar. 25, 2019 and Korean Application No. 10-2019-0112303 filed on Sep. 10, 2019 in the Korean Intellectual Property Office, the entire disclosures of which are incorporated herein by reference for all purposes.

BACKGROUND

1. Field

The following description relates to a chip antenna.

2. Description of Background

Fifth generation (5G) communication systems are implemented in higher frequency (mmWave) bands, such as 10 Ghz to 100 GHz bands, to obtain higher data rates. To reduce propagation loss of RF signals and increase transmission distance, large-scale scale antenna techniques, such as beamforming, large-scale multiple-input multiple-output (MIMO), full dimensional multiple-input multiple-output (MIMO), array antennas, and analog beamforming, are discussed in relation to 5G communication systems.

On the other hand, with regard to mobile communication terminals such as mobile phones, personal data/digital assistants (PDAs), navigation, notebooks that support wireless communications, a trend of adding functions such as code division multiple access (CDMA), wireless local area network (LAN), digital multimedia broadcasting (DMB), and Near Field Communication (NFC) is developing. One of the important aspects of enabling such functions is the antenna.

However, in the GHz band to which the 5G communication system is applied, it is difficult to use the related art antenna because the wavelength is reduced to just a few mm. Therefore, there is a demand for an array antenna module which is very small in size to be mounted in a mobile communication terminal and which is suitable for the GHz band.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Examples provide a chip antenna capable of effectively removing process errors by placing a patch in a groove formed with high precision.

In one general aspect, a chip antenna includes a first ceramic substrate, a second ceramic substrate disposed to face the first ceramic substrate, a first patch disposed on the first ceramic substrate to operate as a feed patch, and a second patch disposed on the second ceramic substrate to operate as a radiation patch. One or both of the first ceramic substrate and the second ceramic substrate include a groove, and one or both of the first patch and the second patch is disposed in the groove of the respective first ceramic substrate and second ceramic substrate and protrudes from the groove.

The one or both of the first patch and the second patch disposed in the groove may have a thickness greater than a depth of the groove.

The one or both of the first patch and the second patch disposed in the groove may be disposed in an entire area formed by the groove.

The first ceramic substrate may include a first groove disposed in a surface that faces the second ceramic substrate, and the first patch may be disposed in the first groove.

The second ceramic substrate may include a first groove disposed in a surface opposite to a surface that faces the first ceramic substrate, and the second patch may be disposed in the first groove.

The second ceramic substrate may include a first groove disposed in a surface that faces the first ceramic substrate, and the second patch may be disposed in the first groove.

The chip antenna may include a spacer disposed between the first ceramic substrate and the second ceramic substrate.

The chip antenna may include a bonding layer disposed between the first ceramic substrate and the second ceramic substrate.

In another general aspect, a chip antenna includes a first ceramic substrate; a second ceramic substrate disposed to face the first ceramic substrate; a first patch disposed on the first ceramic substrate and to which a feed signal is applied; and a second patch disposed on the second ceramic substrate and coupled to the first patch. The second ceramic substrate includes a groove that forms a step in a thickness direction, and the second patch is disposed in the groove to completely fill the step.

A thickness of the second patch may be equal to a depth of the groove.

The second patch may be disposed in an entire area formed by the groove.

The groove may be disposed in a surface of the second ceramic substrate that opposes a surface of the second ceramic substrate facing the first ceramic substrate.

The groove may be disposed in a surface of the second ceramic substrate that faces the first ceramic substrate.

One surface of the first ceramic substrate may include a second groove that forms a second step in a thickness direction, and the first patch may be disposed in the second groove of the first ceramic substrate to completely fill the second step.

One surface of the first ceramic substrate may include a second groove that forms a second step in a thickness direction, and the first patch may be disposed in the second groove and protrude from the second groove.

The chip antenna may include a spacer disposed between the first ceramic substrate and the second ceramic substrate.

The chip antenna may include a bonding layer disposed between the first ceramic substrate and the second ceramic substrate.

In another general aspect, a chip antenna includes a first ceramic substrate including a first groove disposed along a first surface thereof; a second ceramic spaced apart from the first ceramic substrate and including a second groove disposed along a first surface thereof; a feed patch disposed in the first groove; and a radiation patch coupled to the feed patch and disposed in the second groove. The feed patch extends beyond the first surface of the first ceramic substrate and/or the radiation patch extends beyond the first surface of the second ceramic substrate.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depictions of elements in the drawings may be exaggerated for clarity, illustration, and convenience.

DETAILED DESCRIPTION

Figure 1:
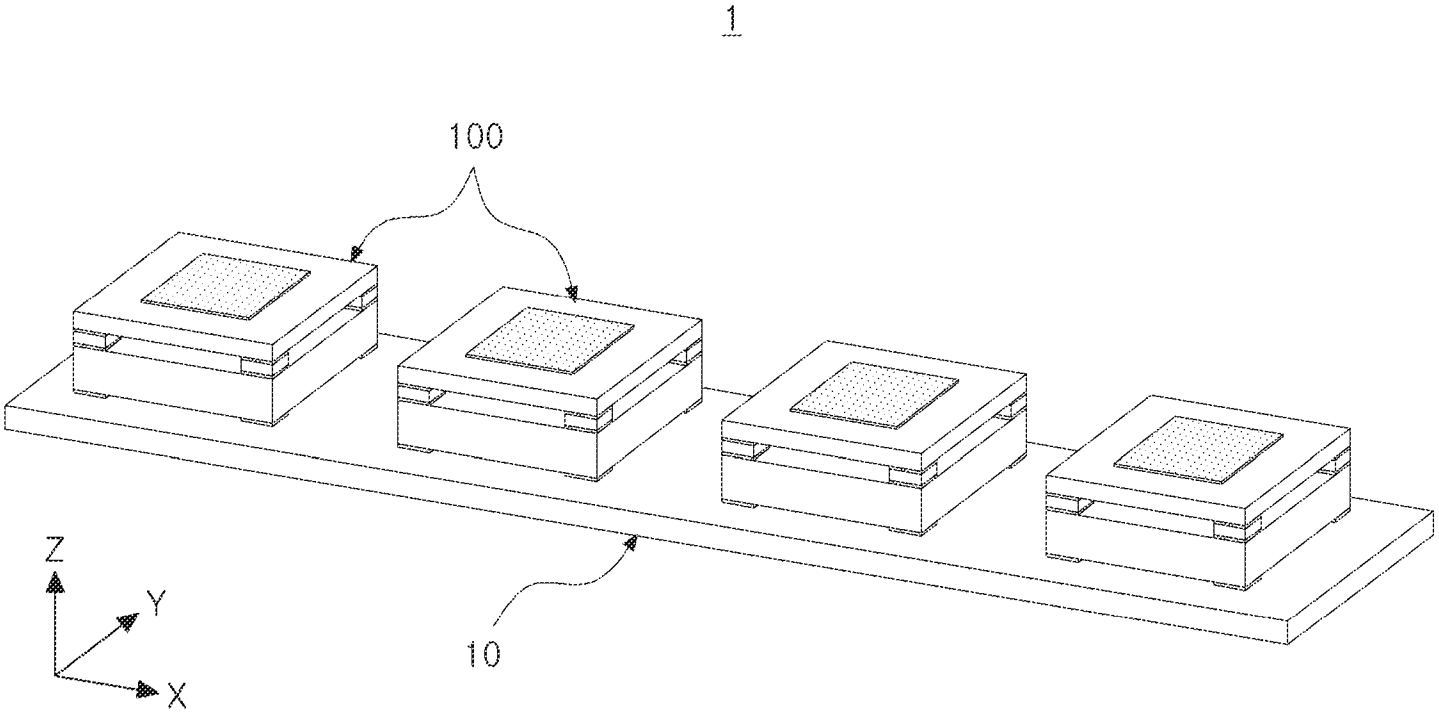
FIG. 1 is a perspective view of a chip antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative size, proportions, and depiction of elements in the drawings may be exaggerated for clarity, illustration, and convenience.

Subsequently, examples are described in further detail with reference to the accompanying drawings.

A chip antenna module according to an example may operate in a high frequency region and may operate in, for example, a frequency band of 3 GHz or more. In addition, a chip antenna module described herein may be mounted on an electronic device configured to receive or to transmit and receive a radio frequency (RF) signal. For example, the chip antenna may be mounted on a portable telephone, a portable notebook, a drone, or the like.

Figure 2A:
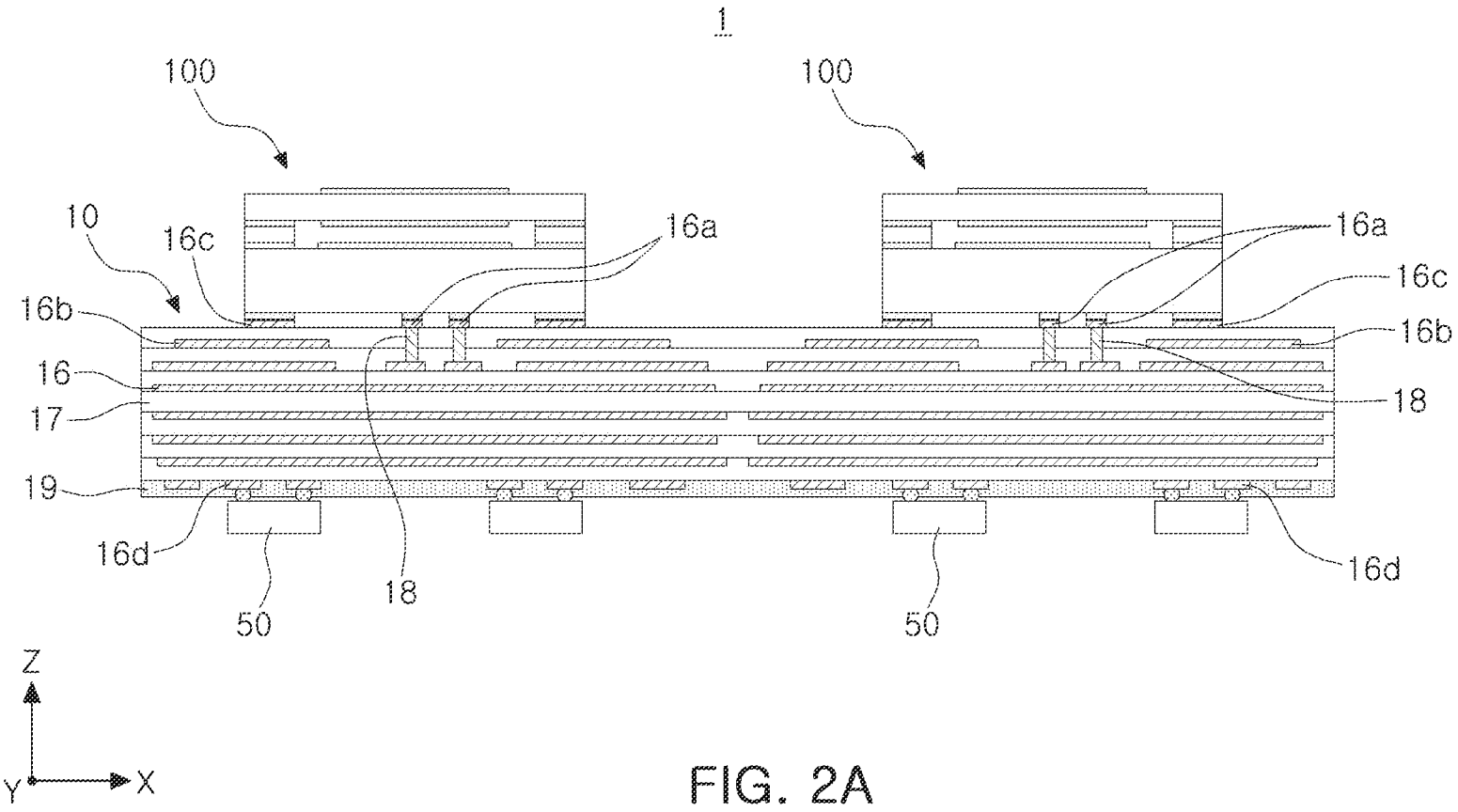
FIG. 2A is a cross-sectional view of a portion of the chip antenna module of FIG. 1.
Figure 3A:
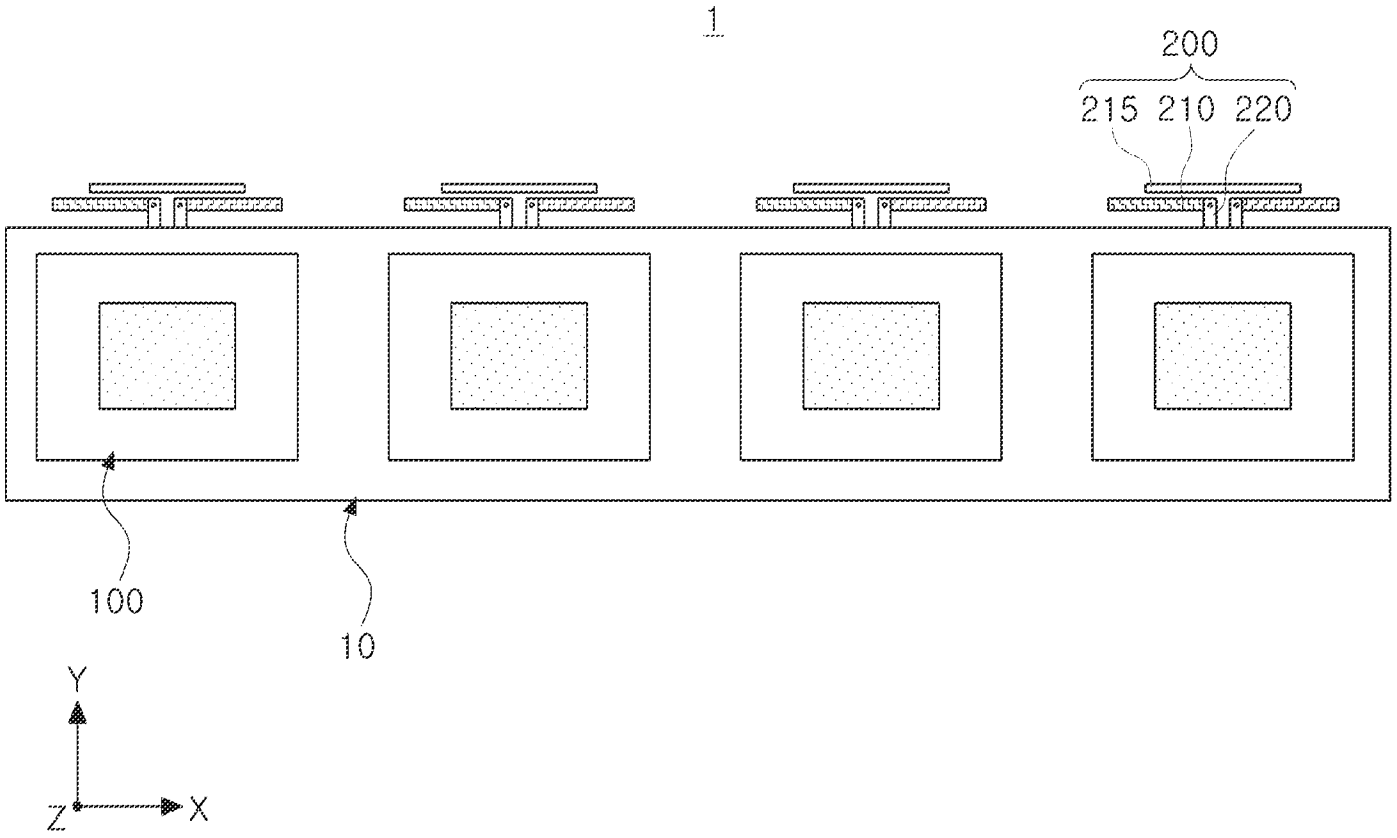
FIG. 3A is a plan view of the chip antenna module of FIG. 1.
Figure 3B:
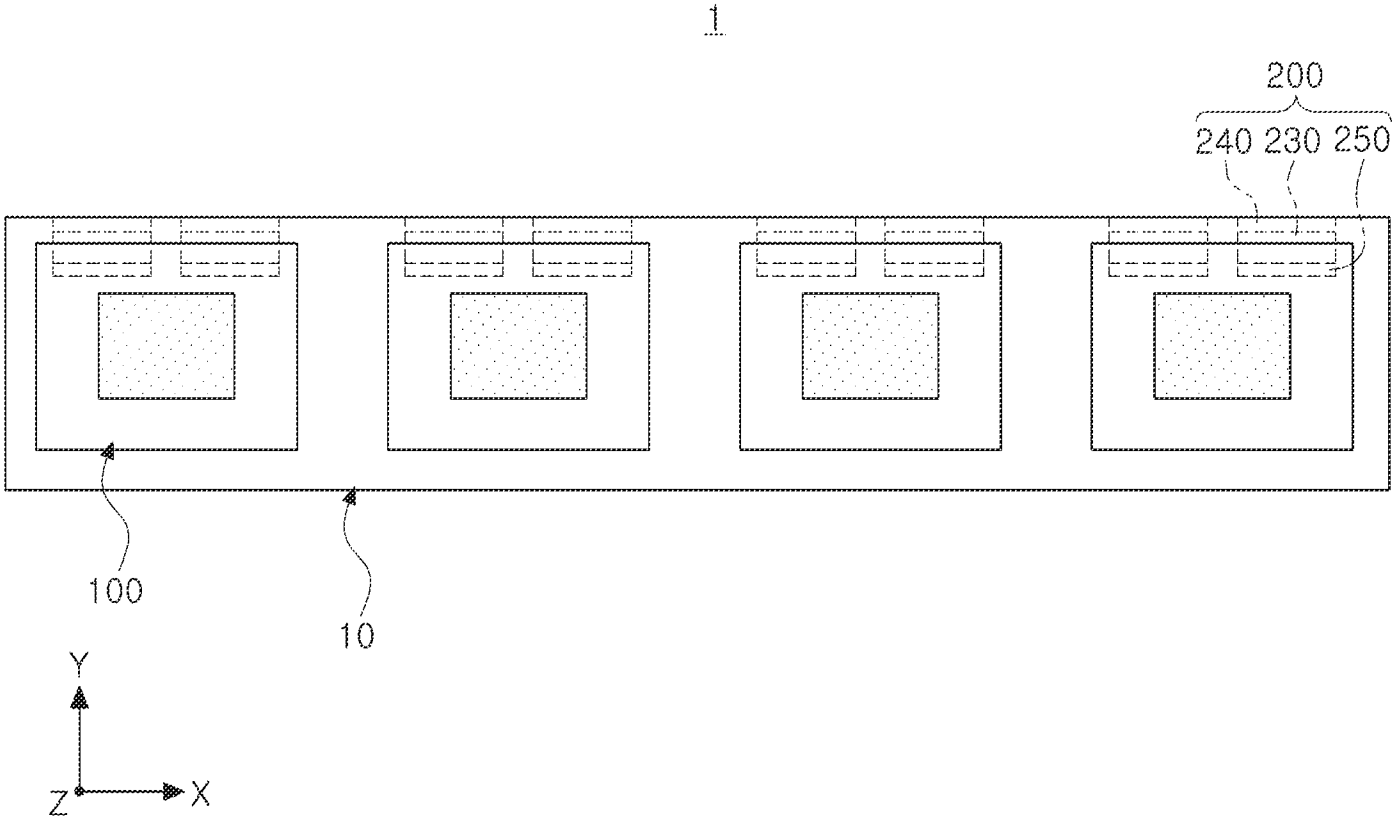
FIG. 3B illustrates a modified example of the chip antenna module of FIG. 3A.

FIG. 1 is a perspective view of a chip antenna module according to an example, FIG. 2A is a cross-sectional view of a portion of the chip antenna module of FIG. 1, FIG. 3A is a plan view of the chip antenna module of FIG. 1, and FIG. 3B illustrates a modified example of the chip antenna module of FIG. 3A.

Referring to FIGS. 1, 2A and 3A, a chip antenna module 1 according to an example includes a substrate 10, an electronic device 50 and a chip antenna 100, and further includes an end-fire antenna 200. At least one electronic device 50, a plurality of chip antennas 100, and a plurality of end-fire antennas 200 may be disposed on the substrate 10.

The substrate 10 may be a circuit board on which a circuit or an electronic component required for the chip antenna 100 is mounted. As an example, the substrate 10 may be a printed circuit board (PCB) having one or more electronic components mounted on a surface thereof. Therefore, the substrate 10 may be provided with circuit wiring electrically connecting the electronic components. The substrate 10 may be implemented as a flexible substrate, a ceramic substrate, a glass substrate, or the like. The substrate 10 may be comprised of a plurality of layers. For example, the substrate 10 may be formed of a multilayer substrate formed by alternately stacking at least one insulating layer 17 and at least one wiring layer 16. The at least one wiring layer 16 may include two outer layers provided on one surface and the other surface of the substrate 10, and at least one inner layer provided between the two outer layers. For example, the insulating layer 17 may be formed of an insulating material such as prepreg, Ajinomoto build-up film (ABF), FR-4, and bismaleimide triazine (BT). The insulating material may be formed of a thermosetting resin such as an epoxy resin, a thermoplastic resin such as polyimide, or a resin formed by impregnating these resins with a core material such as glass fiber, glass cloth, glass fabric, or the like. In some examples, the insulating layer 17 may be formed of a photoimageable dielectric resin.

The wiring layer 16 electrically connects the electronic device 50, the plurality of chip antennas 100, and the plurality of end fire antennas 200. In addition, the wiring layer 16 may electrically connect the plurality of electronic devices 50, the plurality of chip antennas 100, and the plurality of end fire antennas 200 externally.

The wiring layer 16 may be formed of a conductive material such as copper (Cu), aluminum (Al), silver (Ag), tin (Sn), gold (Au), nickel (Ni), lead (Pb), titanium (Ti), alloys thereof, or the like.

In the insulating layer 17, wiring vias 18 are disposed to interconnect the wiring layers 16.

The chip antennas 100 are mounted on one surface of the substrate 10, for example, on an upper surface of the substrate 10. The chip antennas 100 have a width extending in a Y-axis direction, a length extending in an X-axis direction, intersecting the Y-axis direction, for example, perpendicular to the Y-axis direction, and a thickness extending in a Z-axis direction. As illustrated in FIG. 1, the chip antennas 100 may be arranged in a structure of n×1 (where n is a natural number 2 or greater). The plurality of chip antennas 100 may be arranged in the X-axis direction, and surfaces of two chip antennas 100 adjacent to each other in the X-axis direction, among the plurality of chip antennas 100, may face each other in a length direction.

According to an example, the chip antenna 100 may be arranged in a structure of n×m (where n and m are each a natural number 2 or greater). The plurality of chip antennas 100 are arranged in the X-axis direction and the Y-axis direction, in such a manner that surfaces of two chip antennas of the plurality of chip antennas 100, adjacent to each other in the Y-axis direction, may face each other in a width direction, and surfaces of two chip antennas of the plurality of chip antennas 100, adjacent to each other in the X direction, may face each other in the length direction.

Centers of adjacent chip antennas 100 in at least one of the X-axis direction and the Y-axis direction may be spaced apart by $\lambda/2$. In this case, A represents the wavelength of RF signals transmitted and received by the chip antennas 100.

In a case in which the chip antenna module 1 according to an example transmits and receives an RF signal in the 20 GHz to 40 GHz band, the centers of the adjacent chip antennas 100 may be spaced apart by 3.75 mm to 7.5 mm, and in a case in which the chip antenna module 1 transmits and receives an RF signal in a 28 GHz band, the centers of the adjacent chip antennas 100 may be spaced apart by 5.36 mm.

The RF signal used in the 5G communication system has a shorter wavelength and greater energy than those of an RF signal used in the 3G/4G communication system. Therefore, to significantly reduce interference between RF signals transmitted and received by the respective chip antennas 100, the chip antennas 100 need to have a sufficient separation distance.

According to an example, centers of the chip antennas 100 are sufficiently spaced apart by $\lambda/2$ to significantly reduce interference of RF signals transmitted and received by the respective chip antennas 100, thereby using the chip antennas 100 in the 5G communication system.

In examples, the separation distance between centers of adjacent chip antennas 100 may be less than $\lambda/2$. As will be described later, each of the chip antennas 100 is comprised of ceramic substrates and at least one patch provided on a portion of the ceramic substrates. In this case, the ceramic substrates may be spaced apart from each other by a predetermined distance, or a material having a lower dielectric constant than that of the ceramic substrates may be disposed between the ceramic substrates, thereby lowering an overall dielectric constant of the chip antennas 100. As a result, since the wavelength of the RF signals transmitted and received by the chip antennas 100 may be increased to improve radiation efficiency and gain, even when the adjacent chip antennas 100 are disposed in such a manner that the separation distance between the centers of adjacent chip antennas 100 is less than λ/2 of the RF signal, interference between RF signals may be significantly reduced. When the chip antenna module 1 according to an example transmits and receives an RF signal in a 28 GHz band, a separation distance between centers of adjacent chip antennas 100 may be less than 5.36 mm.

A feed pad 16*a* providing a feed signal to the chip antenna 100 is provided on an upper surface of the substrate 10. A ground layer 16*b* is provided in an inner layer of any one of a plurality of layers of the substrate 10. As an example, the wiring layer 16 disposed on a lower layer closest to the upper surface of the substrate 10 is used as the ground layer 16*b*. The ground layer 16*b* operates as a reflector of the chip antenna 100. Therefore, the ground layer 16*b* may concentrate the RF signal by reflecting the RF signal output from the chip antenna 100 in the Z-axis direction corresponding to a directing direction.

In FIG. 2A, the ground layer 16*b* is illustrated as being disposed in a lower layer closest to the upper surface of the substrate 10. However, according to an example, the ground layer 16*b* may be provided on the upper surface of the substrate 10 and may also be provided in other layers.

An upper surface pad 16*c* bonded to the chip antenna 100 is provided on the upper surface of the substrate 10. The electronic device 50 may be mounted on the other surface of the substrate 10, for example, on a lower surface of the substrate 10. A lower surface pad 16*d* electrically connected to the electronic device 50 is provided on the lower surface of the substrate 10.

An insulating protective layer 19 may be disposed on the lower surface of the substrate 10. The insulating protective layer 19 is disposed in such a manner as to cover the insulating layer 17 and the wiring layer 16 on the lower surface of the substrate 10, to protect the wiring layer 16 disposed on the lower surface of the insulating layer 17. For example, the insulating protective layer 19 may include an insulating resin and an inorganic filler. The insulating protective layer 19 may have one or more openings that expose at least a portion of the wiring layer 16. The electronic device 50 may be mounted on the lower surface pad 16*d* through solder balls disposed in the opening(s).

Figure 2B:
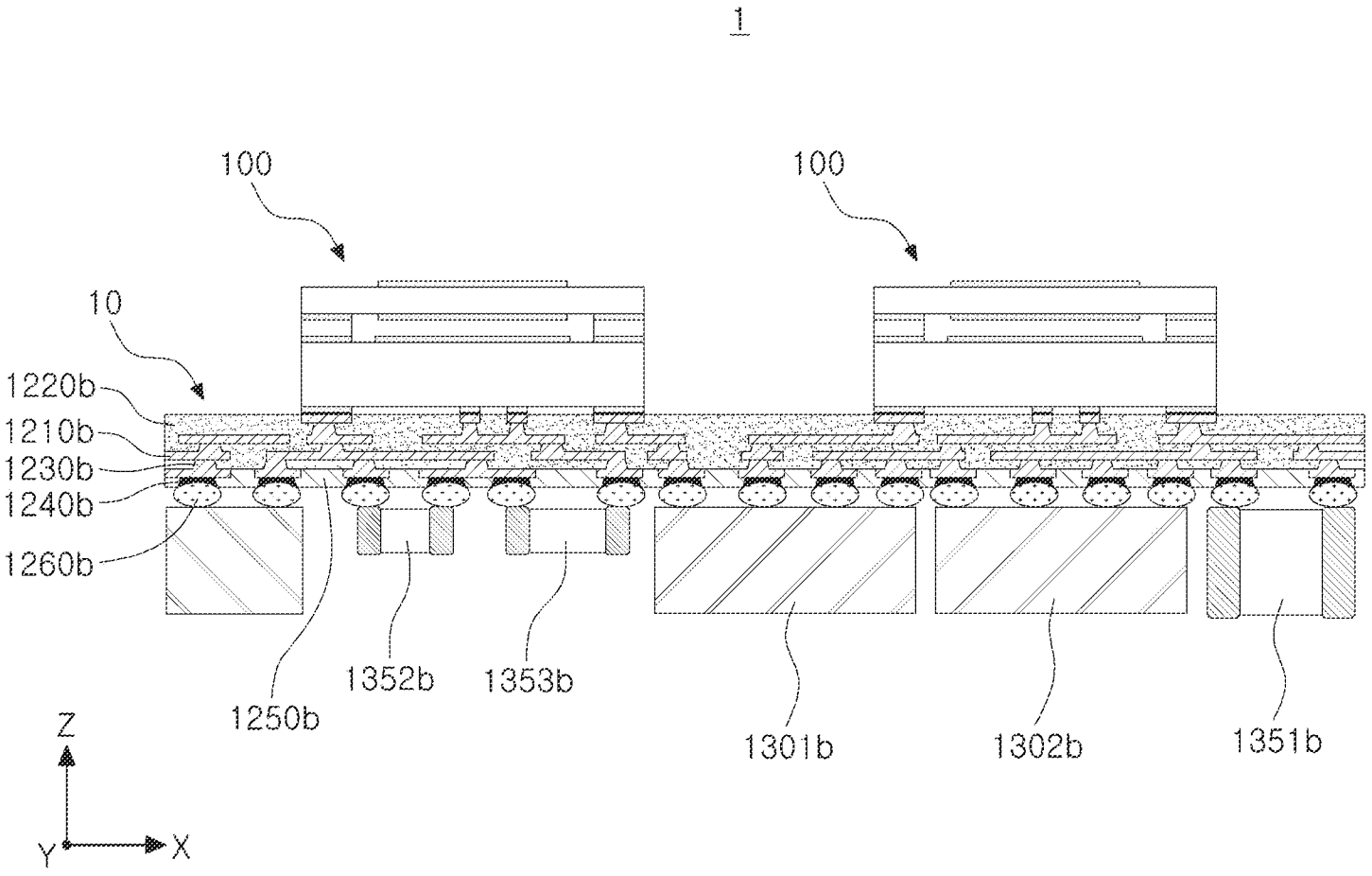
FIGS. 2B and 2C illustrate modified examples of the chip antenna module of FIG. 2A.
Figure 2C:
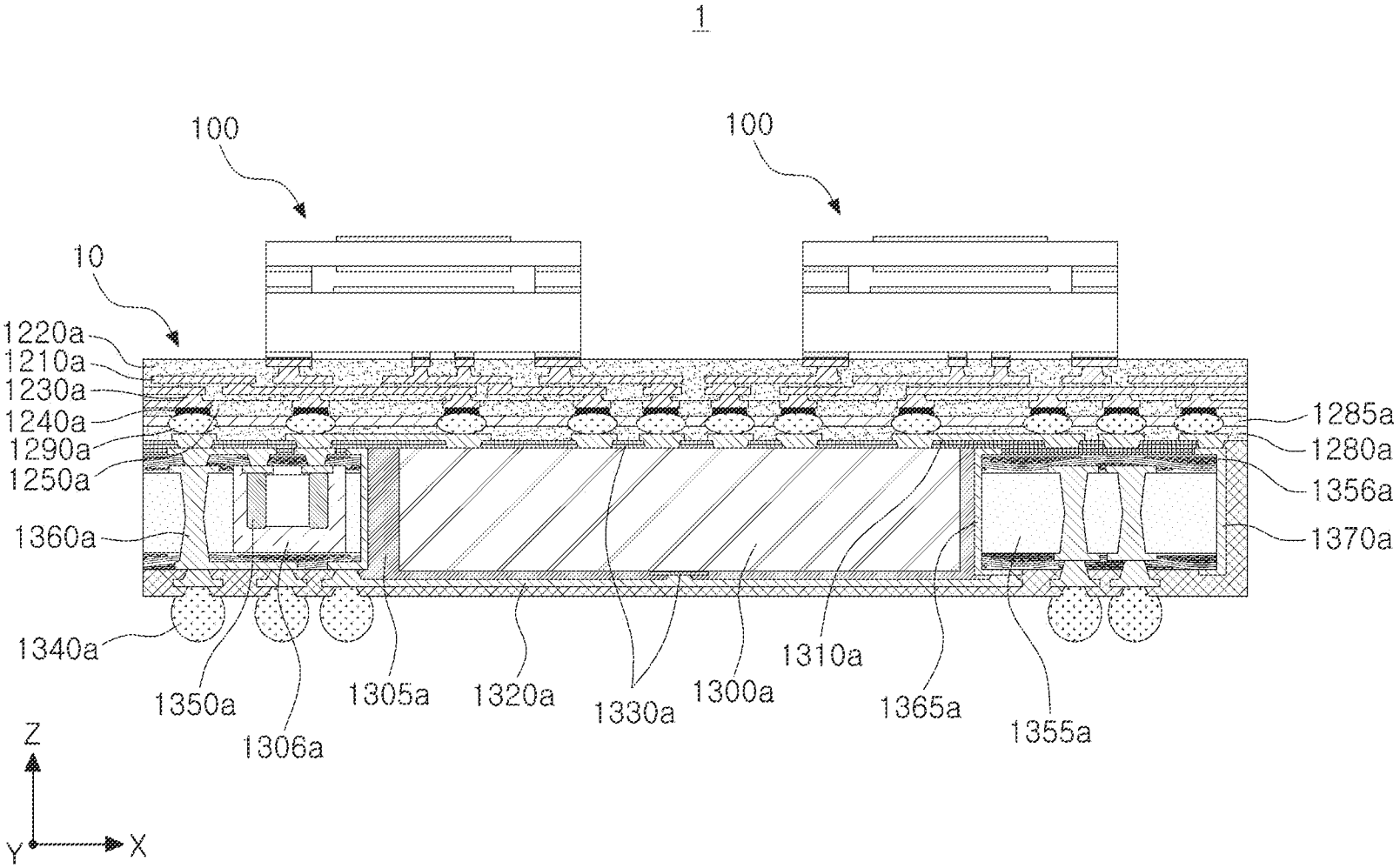

FIGS. 2B and 2C illustrate modified examples of the chip antenna module of FIG. 2A.

Since a chip antenna module according to an example of FIGS. 2B and 2C is similar to the chip antenna module of FIG. 2A, overlapping descriptions will be omitted and descriptions will be provided based on differences.

Referring to FIG. 2B, a substrate 10 includes at least one wiring layer 1210*b*, at least one insulating layer 1220*b*, a wiring via 1230*b* connected to at least one wiring layer 1210*b*, a connection pad 1240*b* connected to the wiring via 1230*b*, and a solder resist layer 1250*b*. The substrate 10 may have a structure similar to a copper redistribution layer (RDL). A chip antenna 100 may be disposed on an upper surface of the substrate 10.

An integrated circuit (IC) 1301*b*, a power management IC (PMIC) 1302*b*, and a plurality of passive components 1351*b*, 1352*b* and 1353*b* may be mounted on a lower surface of the substrate 10 through solder balls 1260*b*. The IC 1301*b* corresponds to an IC for operating a chip antenna module 1. The PMIC 1302*b* generates power and may transfer the generated power to the IC 1301*b* through at least one wiring layer 1210*b* of the substrate 10.

The plurality of passive components 1351*b*, 1352*b* and 1353*b* may provide impedance to the IC 1301*b* and/or the PMIC 1302*b*. For example, the plurality of passive components 1351*b*, 1352*b* and 1353*b* may include at least a portion of a capacitor, an inductor and a chip resistor such as a multilayer ceramic capacitor (MLCC) or the like.

Referring to FIG. 2C, a substrate 10 may include at least one wiring layer 1210*a*, at least one insulating layer 1220*a*, a wiring via 1230*a*, a connection pad 1240*a*, and a solder resist layer 1250*a*.

An electronic component package is mounted on a lower surface of the substrate 10. The electronic component package includes a connecting member that includes an IC 1300*a*, an encapsulant 1305*a* encapsulating at least a portion of the IC 1300*a*, a support member 1355*a* of which a first side faces the IC 1300*a*, at least one wiring layer 1310*a* electrically connected to the IC 1300*a* and the support member 1355*a*, and an insulating layer 1280*a*.

An RF signal generated by the IC 1300*a* may be transmitted to the substrate 10 through at least one wiring layer 1310*a* to be transmitted toward an upper surface of a chip antenna module 1, and the RF signal received by the chip antenna module 1 may be transmitted to the IC 1300*a* through at least one wiring layer 1310*a*.

The electronic component package may further include a connection pad 1330*a* disposed on one surface and/or the other side of the IC 1300*a*. The connection pad 1330*a* disposed on one surface of the IC 1300*a* may be electrically connected to at least one wiring layer 1310*a*, and the connection pad 1330*a* disposed on the other surface of the IC 1300*a* may be electrically connected to the support member 1355*a* or a core plating member 1365*a* through a bottom wiring layer 1320*a*. The core plating member 1365*a* may provide ground to the IC 1300*a*.

The support member 1355*a* may include a core dielectric layer 1356*a* and at least one core via 1360*a* that penetrates through the core dielectric layer 1356*a* and is electrically connected to the bottom wiring layer 1320*a*. The at least one core via 1360*a* may be electrically connected to an electrical connection structure 1340*a* such as a solder ball, a pin, or a land. Accordingly, the support member 1355*a* may receive a base signal or power from the lower surface of the substrate 10 and transmit the base signal and/or power to the IC 1300*a* through the at least one wiring layer 1310*a*.

The IC 1300*a* may generate an RF signal of a millimeter wave (mmWave) band, using a base signal and/or power. For example, the IC 1300*a* may receive a low frequency base signal and perform frequency conversion, amplification, filtering phase control, and power generation of the base signal. The IC 1300*a* may be formed of one of a compound semiconductor, for example, GaAs and a silicon semiconductor to implement high frequency characteristics. The electronic component package may further include a passive component 1350*a* electrically connected to the at least one wiring layer 1310*a*. The passive component 1350*a* may be disposed in an accommodation space 1306*a* provided by the support member 1355*a*. The passive component 1350*a* may include at least a portion of a multilayer ceramic capacitor (MLCC), an inductor and a chip resistor.

The electronic component package may include core plating members 1365*a* and 1370*a* disposed on side surfaces of the support member 1355*a*. The core plating members 1365*a* and 1370*a* may provide ground to the IC 1300*a*, and may dissipate heat from the IC 1300*a* externally or remove noise introduced into the IC 1300*a*.

The configurations of the electronic component package excluding the connecting member, and the connecting member, may be independently manufactured and combined, but may also be manufactured together according to a design. Although FIG. 2C illustrates that the electronic component package is coupled to the substrate 10 through an electrical connection structure 1290*a* and a solder resist layer 1285*a*, the electrical connection structure 1290*a* and the solder resist layer 1285*a* may be omitted according to an example.

Referring to FIG. 3A, the chip antenna module 1 may further include at least one or more end-fire antennas 200. Each of the end-fire antennas 200 may include an end-fire antenna pattern 210, a director pattern 215, and an end-fire feedline 220.

The end-fire antenna pattern 210 may transmit or receive an RF signal in a lateral direction. The end-fire antenna pattern 210 may be disposed on a side of the substrate 10 and may be formed in a dipole form or a folded dipole form. The director pattern 215 may be electromagnetically coupled to the end-fire antenna pattern 210 to improve the gain or bandwidth of the plurality of end-fire antenna patterns 210. The end-fire feedline 220 may transmit an RF signal received from the end-fire antenna pattern 210 to an electronic device or an IC, and may transmit an RF signal received from the electronic device or IC to the end-fire antenna pattern 210.

The end-fire antenna 200 formed by the wiring pattern of FIG. 3A may be implemented as an end-fire antenna 200 having a chip shape as illustrated in FIG. 3B.

Referring to FIG. 3B, each of end-fire antennas 200 includes a body portion 230, a radiating portion 240, and a ground portion 250.

The body portion 230 has a hexahedral shape and is formed of a dielectric substance. For example, the body portion 230 may be formed of a polymer or ceramic sintered body having a predetermined dielectric constant.

The radiating portion 240 is bonded to a first surface of the body portion 230, and the grounding portion 250 is bonded to a second surface of the body portion 230 opposite to the first surface of the body portion 230. The radiating portion 240 and the grounding portion 250 may be formed of the same material. The radiating portion 240 and the grounding portion 250 may be formed of one selected from silver (Ag), gold (Au), copper (Cu), aluminum (Al), platinum (Pt), titanium (Ti), molybdenum (Mo), nickel (Ni) and tungsten (W), or may be formed of an alloy of two or more thereof. The radiating portion 240 and the grounding portion 250 may be formed in the same shape and the same structure. The radiating portion 240 and the grounding portion 250 may be distinguished depending on the type of a pad to be bonded when mounted on the substrate 10. In this case, for example, a portion bonded to a feed pad may function as the radiating portion 240, and a portion bonded to a ground pad may function as the grounding portion 250.

Since the chip-type end-fire antenna 200 has a capacitance due to a dielectric between the radiating portion 240 and the grounding portion 250, the coupling antenna may be designed or the resonance frequency may be tuned using the capacitance.

In the related art, to secure sufficient antenna characteristics of a patch antenna implemented in a pattern form in a multilayer substrate, a plurality of layers is required in the substrate, which causes a problem in which the volume of the patch antenna is excessively increased. The problem is solved by disposing an insulator having a relatively high dielectric constant in the multilayer substrate to reduce a thickness of an insulator and reduce the size and thickness of an antenna pattern.

However, in a case in which the dielectric constant of the insulator is increased, the wavelength of an RF signal is shortened, such that the RF signal is trapped in the insulator having a high dielectric constant, resulting in a significant reduction in radiation efficiency and gain of the RF signal.

According to various examples herein, by implementing a patch antenna, which has been implemented in a pattern form in the related art multilayer substrate, in the form of a chip, thereby significantly reducing the number of layers of the substrate on which the chip antenna is mounted. Therefore, the manufacturing costs and volume of the chip antenna module 1 according to an example may be reduced.

In addition, according to various examples, the dielectric constant of ceramic substrates provided in the chip antenna 100 may be higher than that of an insulating layer provided in the substrate 10, thereby miniaturizing the chip antenna 100.

Furthermore, the ceramic substrates of the chip antenna 100 may be spaced apart from each other by a predetermined distance, or a material having a lower dielectric constant than that of the ceramic substrates may be disposed between the ceramic substrates, thereby lowering an overall dielectric constant of the chip antenna 100. As a result, wavelength of the RF signal may be increased while miniaturizing the chip antenna module 1, thereby improving radiation efficiency and gain. In this case, the overall dielectric constant of the chip antenna 100 may be understood as a dielectric constant formed by the ceramic substrates of the chip antenna 100 and a gap between the ceramic substrates or a dielectric constant formed by the ceramic substrates of the chip antenna 100 and a material between the ceramic substrates. Therefore, when the ceramic substrates of the chip antenna 100 are spaced apart from each other by a predetermined distance, or a material having a lower dielectric constant than that of the ceramic substrates is disposed between the ceramic substrates, the overall dielectric constant of the chip antenna 100 may be lower than that of the ceramic substrates.

Figure 4A:
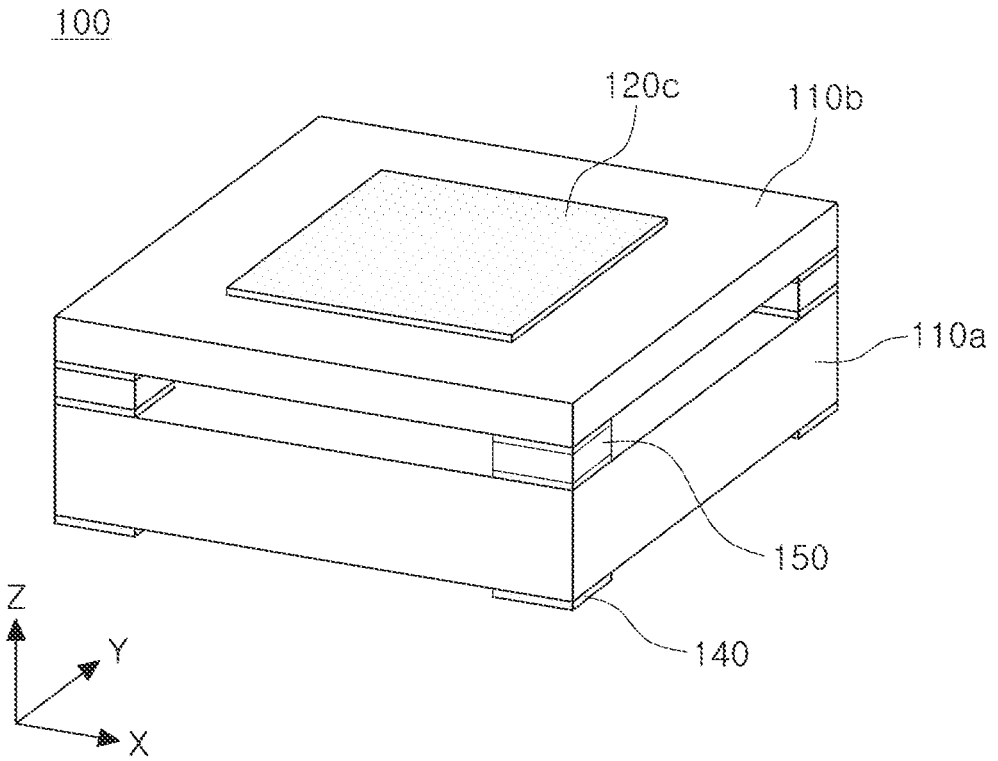
FIG. 4A is a perspective view of a chip antenna according to a first example.
Figure 4B:
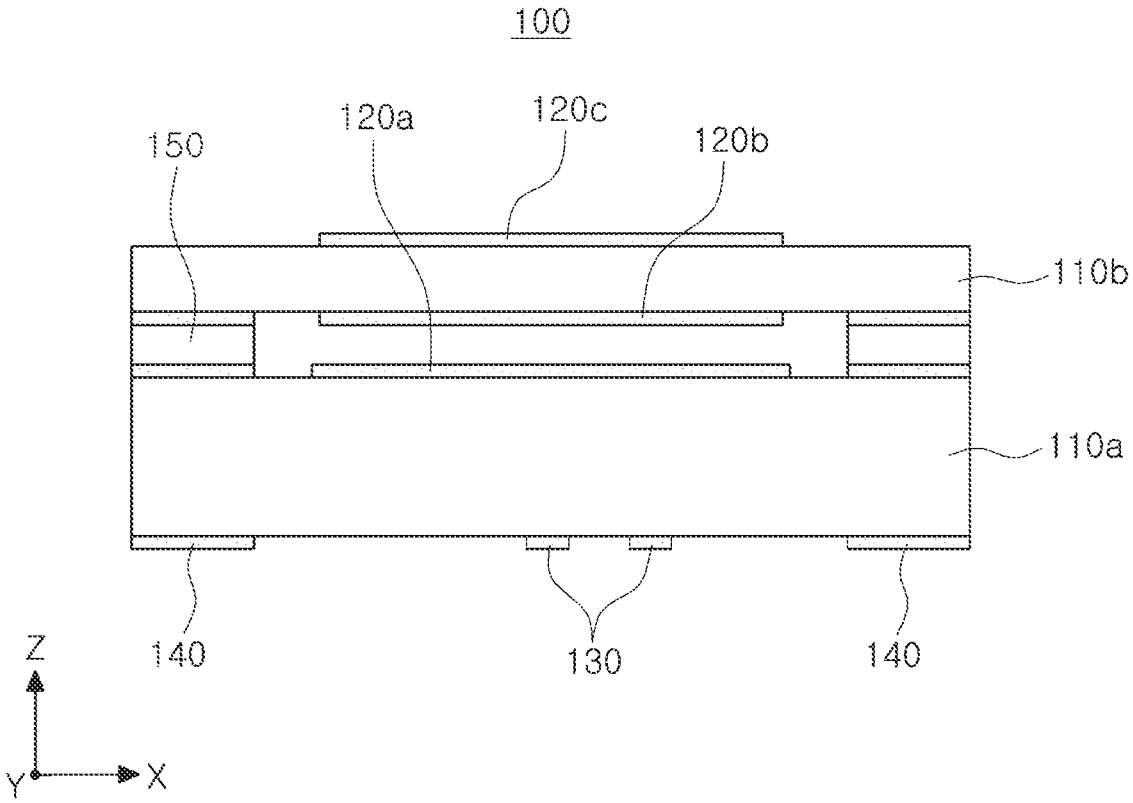
FIG. 4B is a side view of the chip antenna of FIG. 4A.
Figure 4C:
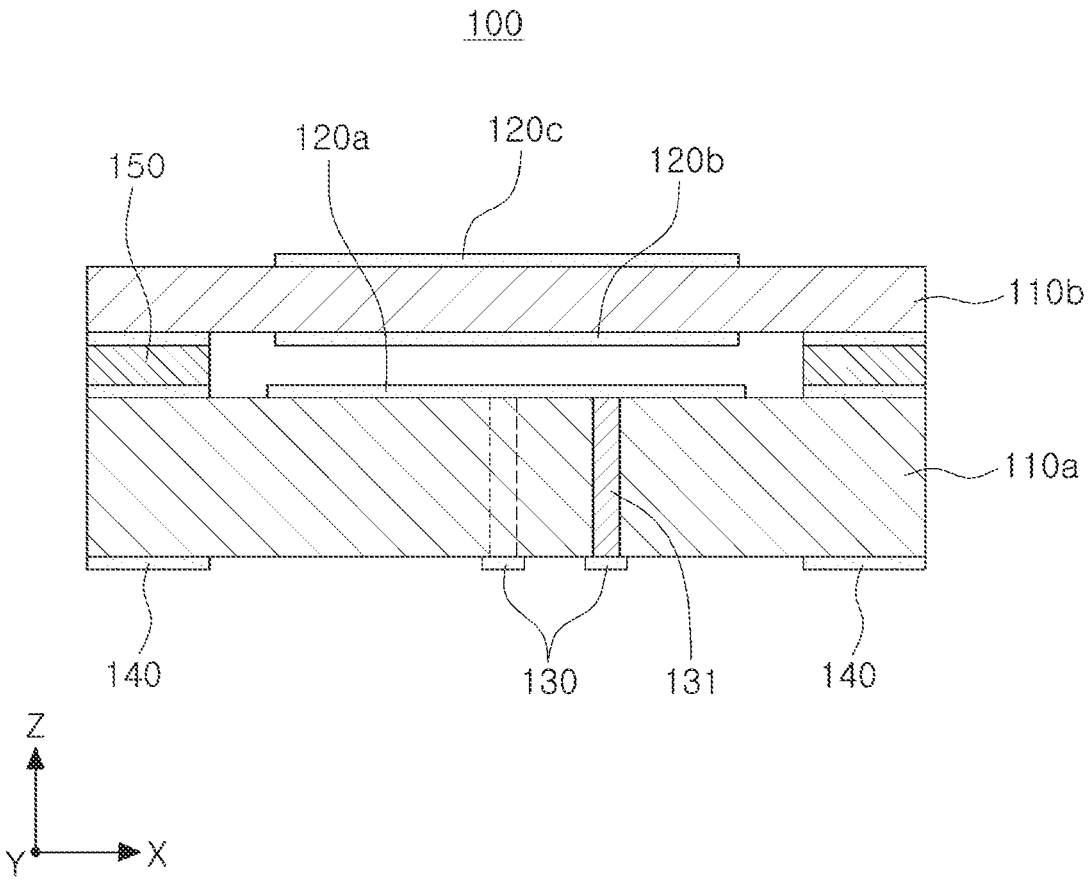
FIG. 4C is a cross-sectional view of the chip antenna of FIG. 4A.
Figure 4D:
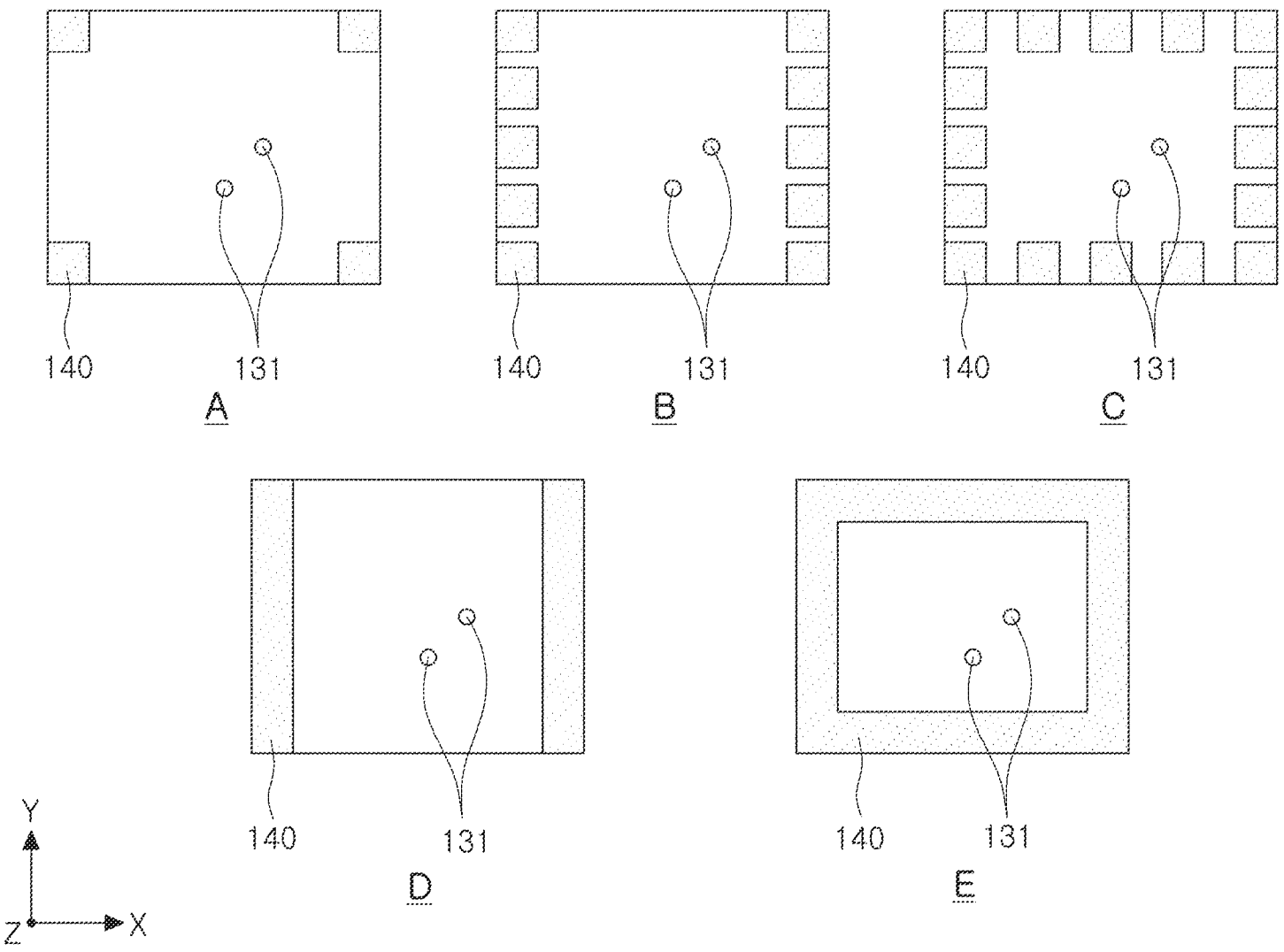
FIG. 4D is a bottom view of the chip antenna of FIG. 4A.
Figure 4E:
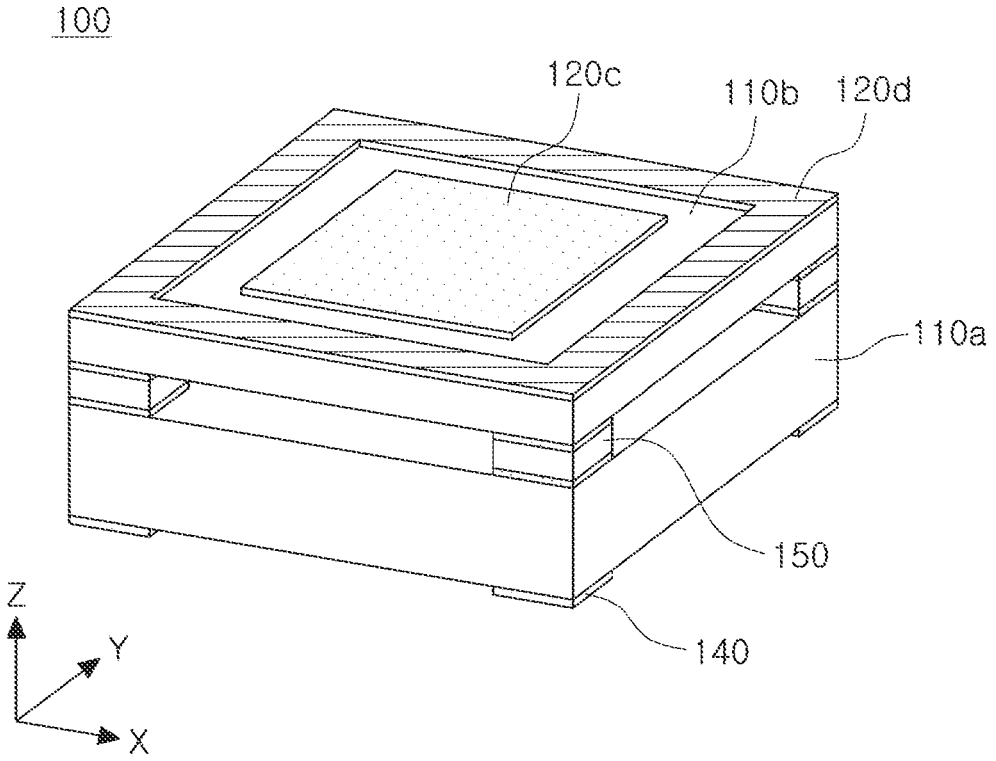
FIG. 4E is a perspective view of a modified example of the chip antenna of FIG. 4A.

FIG. 4A is a perspective view of a chip antenna according to a first example, FIG. 4B is a side view of the chip antenna of FIG. 4A, FIG. 4C is a cross-sectional view of the chip antenna of FIG. 4A, FIG. 4D is a bottom view of the chip antenna of FIG. 4A, and FIG. 4E is a perspective view illustrating a modified example of the chip antenna of FIG. 4A.

Referring to FIGS. 4A, 4B, 4C and 4D, a chip antenna 100 may include a first ceramic substrate 110*a*, a second ceramic substrate 110*b*, and a first patch 120*a*, and may include at least one of a second patch 120*b* and a third patch 120*c*.

The first patch 120*a* is formed of a flat plate metal having a predetermined area. The first patch 120*a* is formed to have a quadrangular shape. According to an example, the first patch 120*a* may be formed in various shapes such as a polygonal shape, a circular shape and the like. The first patch 120*a* may be connected to a feed via 131 to function and operate as a feed patch.

The second patch 120*b* and the third patch 120*c* are spaced apart from the first patch 120*a* by a predetermined distance, and are formed of a flat plate-shaped metal having one constant area. The second patch 120*b* and the third patch 120*c* have the same as or different area from that of the first patch 120*a*. As an example, the second patch 120*b* and the third patch 120*c* may have an area smaller than that of the first patch 120*a* and may be disposed on an upper portion of the first patch 120*a*. As an example, the second patch 120*b* and the third patch 120*c* may be formed to be 5% to 8% smaller than the first patch 120*a*. As an example, a thickness of the first patch 120*a*, the second patch 120*b*, and the third patch 120C may be 20 μm.

The second patch 120*b* and the third patch 120*c* may be electromagnetically coupled with the first patch 120*a*, to function and operate as a radiation patch. The second patch 120*b* and the third patch 120*c* may further concentrate the RF signal in the Z-axis direction corresponding to a mounting direction of the chip antenna 100 to improve the gain or bandwidth of the first patch 120*a*. The chip antenna 100 may include at least one of the second patch 120*b* and the third patch 120*c* that function as radiation patches.

The first patch 120*a*, the second patch 120*b*, and the third patch 120*c* may be formed of one selected from Ag, Au, Cu, Al, Pt, Ti, Mo, Ni and W, or an alloy of two or more thereof. In addition, the first patch 120*a*, the second patch 120*b*, and the third patch 120*c* may be formed of a conductive paste or a conductive epoxy.

The first patch 120*a*, the second patch 120*b*, and the third patch 120*c* may be prepared by stacking copper foils on the ceramic substrates, forming electrodes and then patterning the formed electrodes into designed shapes. Using an etching process, such as a lithography process, the electrodes may be patterned. The electrode may be formed using subsequent electroplating after forming a seed by electroless plating. In addition, after the seed is formed by sputtering, the electrode may be formed using subsequent electrolytic plating.

The first patch 120*a*, the second patch 120*b*, and the third patch 120*c* may be formed by printing and curing a conductive paste or a conductive epoxy on a ceramic substrate. Through the printing process, the first patch 120*a*, the second patch 120*b*, and the third patch 120*c* may be directly formed in a designed shape without a separate etching process.

According to an example, on the first patch 120*a*, the second patch 120*b* and the third patch 120*c*, a plating layer may be additionally formed in the form of a film along respective surfaces of the first patch 120*a*, the second patch 120*b* and the third patch 120*c*. The plating layer may be formed on respective surfaces of the first patch 120*a*, the second patch 120*b* and the third patch 120*c* through a plating process. The plating layer may be formed by sequentially laminating a nickel (Ni) layer and a tin (Sn) layer, or by sequentially laminating a zinc (Zn) layer and a tin (Sn) layer. The plating layer is formed on each of the first patch 120*a*, the second patch 120*b* and the third patch 120*c* to prevent oxidation of the first patch 120*a*, the second patch 120*b*, and the third patch 120*c*. The plating layer may also be formed along surfaces of a feed pad 130, the feed via 131, a bonding pad 140 and a spacer 150, which will be described later.

The first ceramic substrate 110*a* may be formed of a dielectric having a predetermined dielectric constant. For example, the first ceramic substrate 110*a* may be formed of a ceramic sintered body having a hexahedral shape. The first ceramic substrate 110*a* may include magnesium (Mg), silicon (Si), aluminum (Al), calcium (Ca), and titanium (Ti). As an example, the first ceramic substrate 110*a* may include Mg2SiO4, MgAl2O4, and CaTiO3. As another example, the first ceramic substrate 110*a* may further include MgTiO3 in addition to Mg2SiO4, MgAl2O4, and CaTiO3, and according to an example, MgTiO3 replaces CaTiO3, so that the first ceramic substrate 110*a* includes Mg2SiO4, MgAl2O4, and MgTiO3.

When a distance between a ground layer 16*b* of the chip antenna module 1 and the first patch 120*a* of the chip antenna 100 corresponds to λ/10 to λ/20, the ground layer 16*b* may efficiently reflect the RF signal output by the chip antenna 100 in the directing direction.

When the ground layer 16*b* is provided on the upper surface of the substrate 10, the distance between the ground layer 16*b* of the chip antenna module 1 and the first patch 120*a* of the chip antenna 100 is substantially the same as a sum of a thickness of the first ceramic substrate 110*a* and a thickness of the bonding pad 140.

Therefore, the thickness of the first ceramic substrate 110*a* may be determined depending on a design distance λ/10 to λ/20 of the ground layer 16*b* and the first patch 120*a*. As an example, the thickness of the first ceramic substrate 110*a* may correspond to 90 to 95% of λ/10 to λ/20. For example, when the dielectric constant of the first ceramic substrate 110*a* is 5 to 12 at 28 GHz, the thickness of the first ceramic substrate 110*a* may be 150 to 500 μm.

The first patch 120*a* is provided on one surface of the first ceramic substrate 110*a*, and the feed pad 130 is provided on the other surface of the first ceramic substrate 110*a*. At least one feed pad 130 may be provided on the other surface of the first ceramic substrate 110*a*. The feed pad 130 may have a thickness of 20 μm.

The feed pad 130 provided on the other surface of the first ceramic substrate 110*a* is electrically connected to the feed pad 16*a* provided on one surface of the substrate 10. The feed pad 130 is electrically connected to the feed via 131 penetrating through the first ceramic substrate 110*a* in a thickness direction, and the feed via 131 may provide a feed signal to the first patch 110*a* provided on one surface of the first ceramic substrate 110*a*. As the feed via 131, at least one feed via may be provided. For example, two feed vias 131 may be provided to correspond to two feed pads 130. One feed via 131 of the two feed vias 131 corresponds to a feed line for generating vertical polarization, and the other feed via 131 corresponds to a feed line for generating horizontal polarization. A diameter of the feed via 131 may be 150 μm. The bonding pad 140 is provided on the other surface of the first ceramic substrate 110*a*. The bonding pad 140 provided on the other surface of the first ceramic substrate 110*a* is bonded to an upper surface pad 16*c* provided on one surface of the substrate 10. For example, the bonding pad 140 of the chip antenna 100 may be bonded to the upper surface pad 16*c* of the substrate 10 through solder paste. The bonding pad 140 may have a thickness of 20 μm.

Referring to A of FIG. 4D, as the bonding pad 140, a plurality of bonding pads may be provided and may be provided at respective corners of a quadrangular shape on the other surface of the first ceramic substrate 110*a*.

Referring to B of FIG. 4D, the plurality of bonding pads 140 may be disposed along one side of the quadrangular shape and the other side thereof opposing the one side on the other surface of the first ceramic substrate 110*a*, such that the plurality of bonding pads 140 are spaced apart from each other by a predetermined distance.

Referring to C of FIG. 4D, the plurality of bonding pads 140 may be provided along four sides of the quadrangular shape on the other surface of the first ceramic substrate 110*a*, such that the plurality of bonding pads 140 are spaced apart from each other by a predetermined distance.

Referring to D of FIG. 4D, the bonding pad 140 is respectively disposed along one side of the quadrangular shape and the other side thereof opposite to the one side, on the other surface of the ceramic substrate 110*a*, and may be provided in the form, respectively having a length corresponding to one side of the quadrangular shape and a length corresponding to the other side thereof.

Referring to E of FIG. 4D, the bonding pad 140 may be provided in the form having lengths corresponding to four sides by being disposed along the respective four sides of the quadrangular shape on the other surface of the first ceramic substrate 110*a*.

In A, B and C of FIG. 4D, the bonding pads 140 are illustrated in a quadrangular shape, but according to examples, the bonding pads 140 may be formed in various shapes such as a circle or the like. In addition, although A, B, C, D and E of FIG. 4D illustrate that the bonding pads 140 are disposed adjacent to four sides of a quadrangular shape, the bonding pads 140 may be disposed to be spaced apart from the four sides by a predetermined distance according to an example.

The second ceramic substrate 110*b* may be formed of a dielectric having a predetermined dielectric constant. For example, the second ceramic substrate 110*b* may be formed of a ceramic sintered body having a hexahedral shape similar to that of the first ceramic substrate 110*a*. The second ceramic substrate 110*b* may have the same dielectric constant as that of the first ceramic substrate 110*a*, and according to an example, may have a dielectric constant different from that of the first ceramic substrate 110*a*. For example, the dielectric constant of the second ceramic substrate 110*b* may be higher than that of the first ceramic substrate 110*a*. According to an example, when the dielectric constant of the second ceramic substrate 110*b* is higher than that of the first ceramic substrate 110*a*, the RF signal is radiated toward the second ceramic substrate 110*b* having a relatively high dielectric constant, thereby improving the gain of the RF signal.

The second ceramic substrate 110*b* may have a thickness less than that of the first ceramic substrate 110*a*. The thickness of the first ceramic substrate 110*a* may correspond to 1 to 5 times the thickness of the second ceramic substrate 110*b*, and for example, may correspond to 2 to 3 times the thickness of the second ceramic substrate 110*b*. For example, the thickness of the first ceramic substrate 110*a* may be 150 to 500 μm, and the thickness of the second ceramic substrate 110*b* may be 100 to 200 μm, and for example, may be 50 to 200 μm. According to an example, the second ceramic substrate 110*b* may also have the same thickness as that of the first ceramic substrate 110*a*.

According to an example, depending on the thickness of the second ceramic substrate 110*b*, the first patch 120*a* and the second patch 120*b*/third patch 120*c* maintain an appropriate distance therebetween, thereby improving radiation efficiency of the RF signal.

The dielectric constants of the first ceramic substrate 110*a* and the second ceramic substrate 110*b* may be higher than a dielectric constant of the substrate 10, for example, a dielectric constant of an insulating layer 17 provided on the substrate 10. For example, the dielectric constant of the first ceramic substrate 110*a* and the second ceramic substrate 110*b* may be 5 to 12 at 28 GHz, and the dielectric constant of the substrate 10 may be 3 to 4 at 28 GHz. As a result, the volume of the chip antenna may be reduced, and the overall chip antenna module may be miniaturized. As an example, the chip antenna 100 according to an example may be manufactured in the form of a small chip having a length of 3.4 mm, a width of 3.4 mm, and a thickness of 0.64 mm. The second patch 120*b* is provided on the other surface of the second ceramic substrate 110*b*, and the third patch 120*c* is provided on one surface of the second ceramic substrate 110*b*.

Referring to FIG. 4E, a shielding electrode 120*d* is formed along an edge of the second ceramic substrate 110*b* on one surface of the second ceramic substrate 110*b* to be insulated from the third patch 120*c*. The shielding electrode 120*d* may reduce interference between the chip antennas 100 when the chip antennas 100 are arranged in an array such as a structure of n×1. Thus, when the chip antennas 100 are arranged in an array of 4×1, the chip antenna module 1 according to an example may be manufactured to have a length of 19 mm, a width of 4.0 mm, and a thickness of 1.04 mm.

The first ceramic substrate 110*a* and the second ceramic substrate 110*b* may be spaced apart from each other through the spacer 150. The spacer 150 may be provided at each corner of a quadrangular shape of the first ceramic substrate 110*a*/the second ceramic substrate 110*b*, between the first ceramic substrate 110*a* and the second ceramic substrate 110*b*. According to an example, the spacer 150 may be provided on one side and the other side of the first ceramic substrate 110*a*/the second ceramic substrate 110*b* having quadrangular shapes, or may be provided on four sides of the first ceramic substrate 110*a*/the second ceramic substrate 110*b* having quadrangular shapes, to stably support the second ceramic substrate 110*b* on the upper portion of the first ceramic substrate 110*a*. Therefore, a gap may be provided between the first patch 120*a* provided on one surface of the first ceramic substrate 110*a* and the second patch 120*b* provided on the other surface of the second ceramic substrate 110*b*, by the spacer 150. As air having a dielectric constant of 1 fills a space formed by the gap, the overall dielectric constant of the chip antenna 100 may be lowered.

According to an example, the first ceramic substrate 110*a* and the second ceramic substrate 110*b* are formed of a material having a dielectric constant higher than that of the substrate 10, thereby miniaturizing the chip antenna module. In addition, by providing a gap between the first ceramic substrate 110*a* and the second ceramic substrate 110*b* to lower the overall dielectric constant of the chip antenna 100, radiation efficiency and gain may be improved.

FIGS. 5A through 5F illustrate a method of manufacturing a chip antenna according to a first example. In FIGS. 5A through 5F, one chip antenna is illustrated to be manufactured separately, but according to an example, after a plurality of chip antennas are integrally formed through a manufacturing method described below, the plurality of chip antennas integrally formed may be cut through a cutting process and may be separated into individual chip antennas.

Figure 5A:
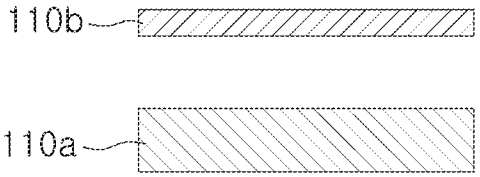
FIGS. 5A, 5B, 5C, 5D, 5E, and 5F illustrate a method of manufacturing a chip antenna according to the first example.
Figure 5B:
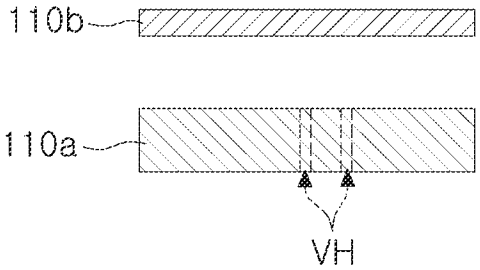
Figure 5C:
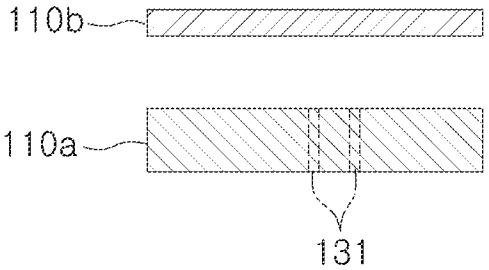

Referring to FIGS. 5A through 5F, a method of manufacturing a chip antenna according to an example starts with preparing a first ceramic substrate 110*a* and a second ceramic substrate 110*b* (see FIG. 5A). Subsequently, via holes VH are formed to penetrate through the first ceramic substrate 110*a* in a thickness direction (see FIG. 5B), and a conductive paste is applied to or filled in the via holes VH (see FIG. 5C) to form feed vias 131. The conductive paste may be filled in the entire interior of the via holes VH, or may be applied to inner surfaces of the via holes VH to a predetermined thickness.

Figure 5D:
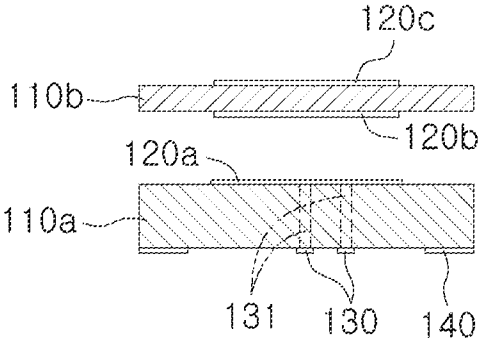

After the feed vias 131 are formed, a conductive paste or a conductive epoxy is printed and cured on the first ceramic substrate 110*a* and the second ceramic substrate 110*b*, to form a first patch 120*a* on one surface of the first ceramic substrate 110*a*, form feed pads 130 and a bonding pad 140 on the other surface of the first ceramic substrate 110*a*, form a second patch 120*b* on the other surface of the second ceramic substrate 110*b*, and form a third patch 120*c* on one surface of the second ceramic substrate 110*b* (see FIG. 5D).

Figure 5E:
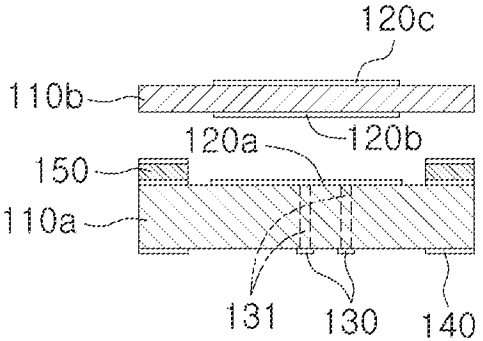
Figure 5F:
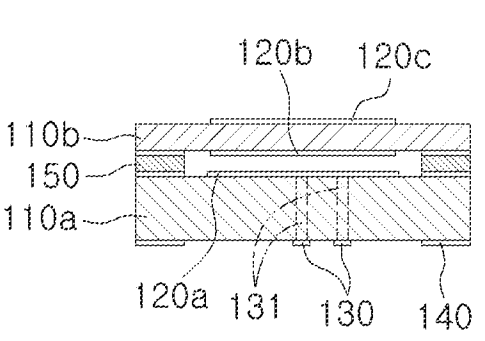

Subsequently, a conductive paste or a conductive epoxy is thick-film printed and cured on an edge of one surface of the first ceramic substrate 110*a* to form a spacer 150 (see FIG. 5E). After the formation of the spacer 150, the conductive paste or the conductive epoxy is additionally printed one or more times in the area in which the spacer 150 is formed, and before the printed conductive paste or conductive epoxy is cured, the second ceramic substrate 110*b* is pressed with the spacer 150 (see FIG. 5F). Subsequently, after the conductive paste or the conductive epoxy provided in the region in which the spacer 150 is formed is cured, a plating layer is formed on the first patch 120*a*, the second patch 120*b*, the third patch 120*c*, the feed pads 130, the feed vias 131, the bonding pad 140, and the spacer 150, through a plating process. The plating layer may prevent oxidation of the first patch 120*a*, the second patch 120*b*, the third patch 120*c*, the feed pads 130, the feed vias 131, the bonding pad 140, and the spacer 150. Subsequently, a plurality of integrally-formed chip antennas is separated through a cutting process, such that individual chip antennas may be manufactured.

Figure 6A:
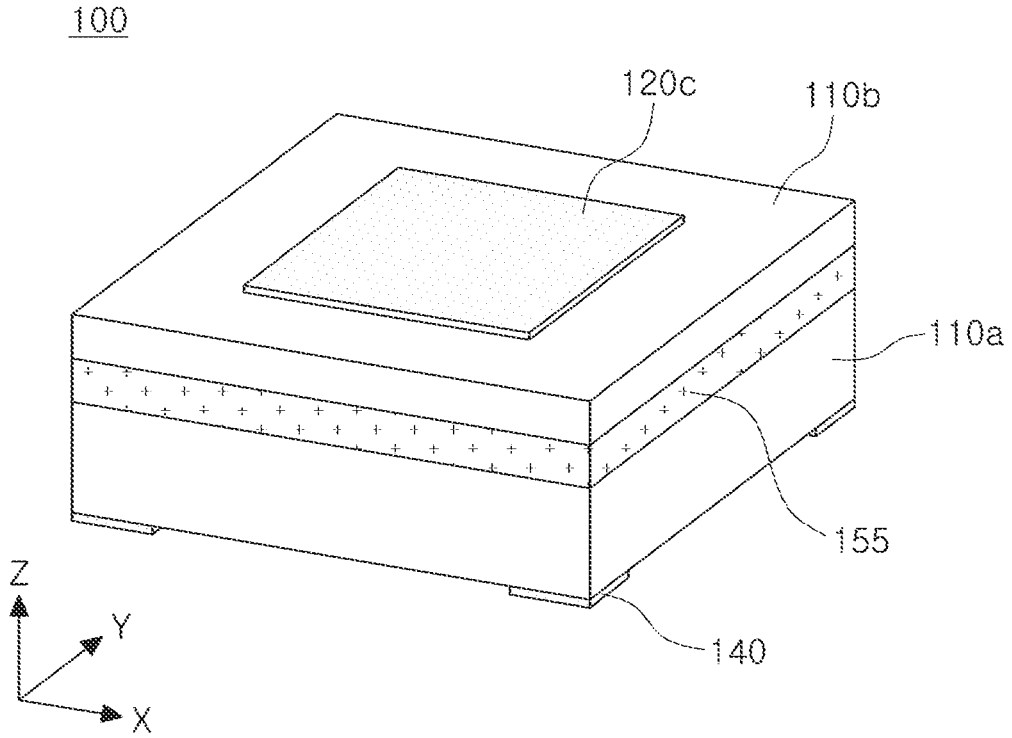
FIG. 6A is a perspective view of a chip antenna according to a second example.
Figure 6B:
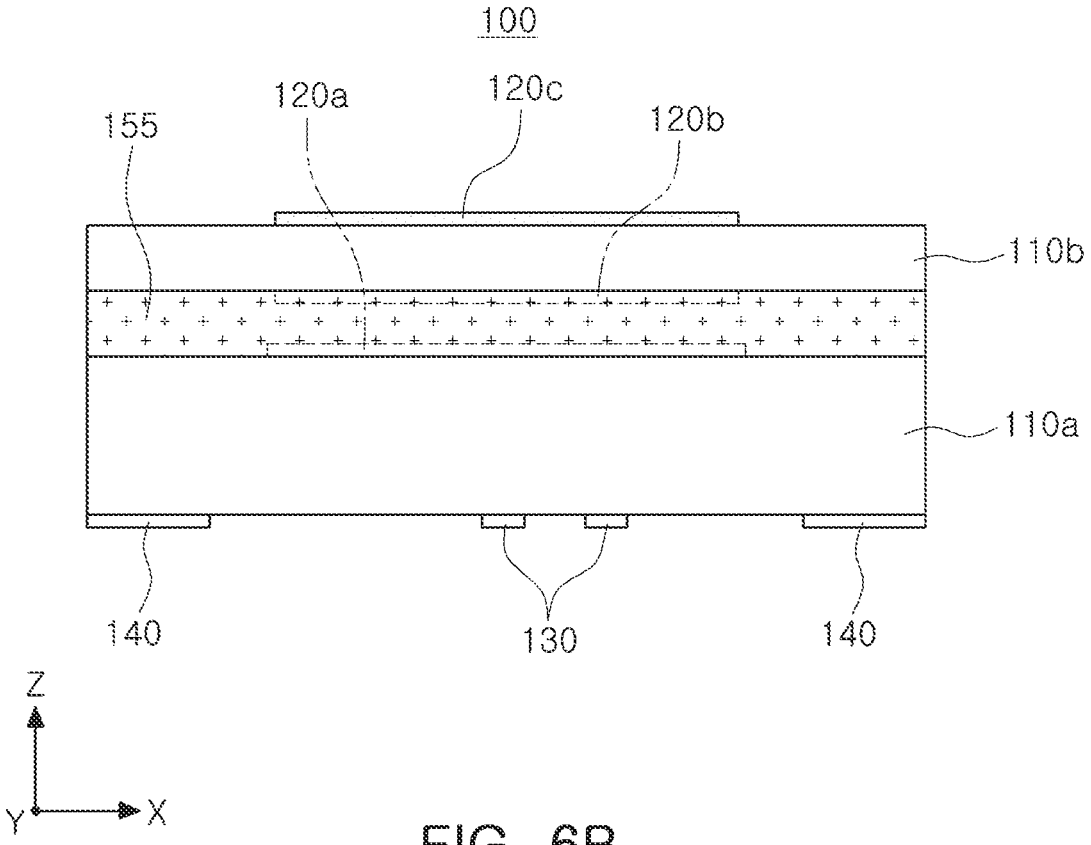
FIG. 6B is a side view of the chip antenna of FIG. 6A.
Figure 6C:
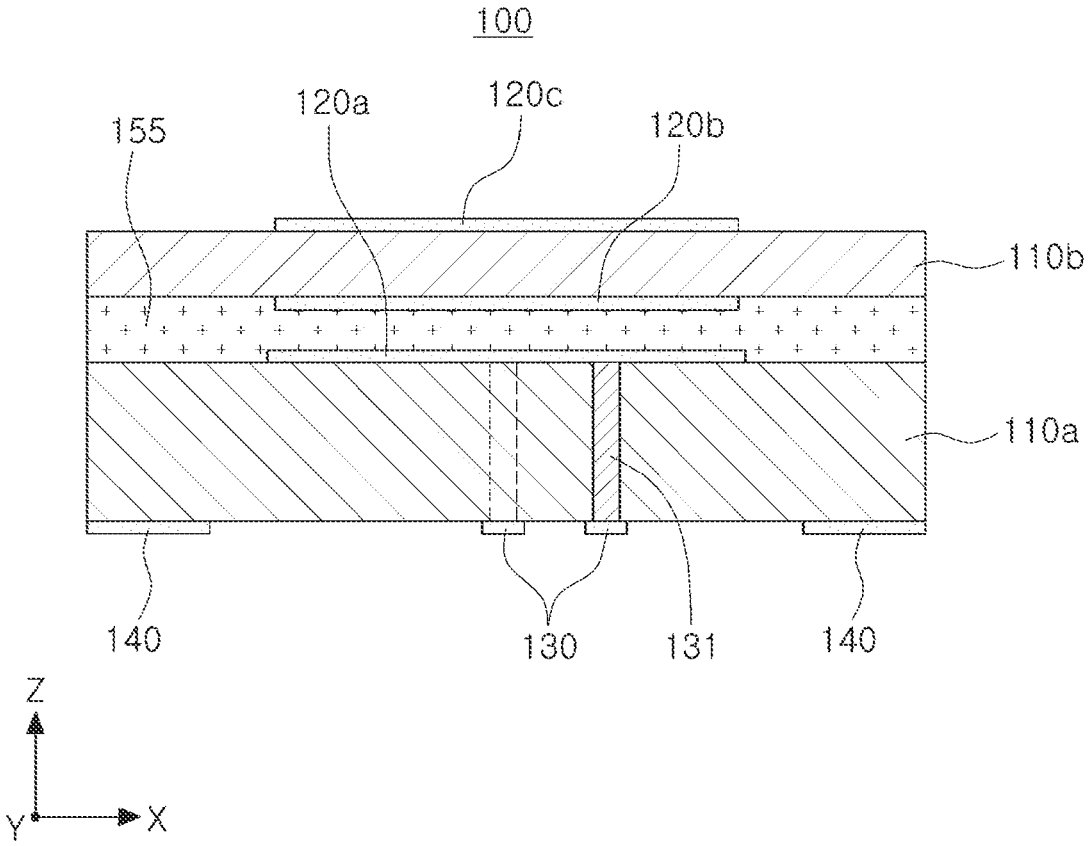
FIG. 6C is a cross-sectional view of the chip antenna of FIG. 6A.

FIG. 6A is a perspective view of a chip antenna according to a second example, FIG. 6B is a side view of the chip antenna of FIG. 6A, and FIG. 6C is a cross-sectional view of the chip antenna of FIG. 6A. Since the chip antenna according to the second example has some similarities to the chip antenna according to the first example, overlapping descriptions will be omitted and descriptions of the second example will be provided based on differences.

While the first ceramic substrate 110*a* and the second ceramic substrate 110*b* of the chip antenna 100 according to the first example are disposed to be spaced apart from each other through the spacer 150, in the case of the chip antenna 100 according to the second example, the first ceramic substrate 110*a* and the second ceramic substrate 110*b* may be bonded to each other through the bonding layer 155. The bonding layer 155 may be understood to be provided in a space formed by a gap between the first ceramic substrate 110*a* and the second ceramic substrate 110*b*.

The bonding layer 155 is formed to cover one surface of the first ceramic substrate 110*a* and the other surface of the second ceramic substrate 110*b*, such that the first ceramic substrate 110*a* and the second ceramic substrate 110*b* may be bonded to each other. The bonding layer 155 may be formed of, for example, a polymer, and for example, the polymer may include a polymer sheet. A dielectric constant of the bonding layer 155 may be lower than that of the first ceramic substrate 110*a* and the second ceramic substrate 110*b*. As an example, the dielectric constant of the bonding layer 155 may be 2 to 3 at 28 GHz, and a thickness of the bonding layer 155 may be 50 to 200 μm.

According to an example, the chip antenna module may be miniaturized by forming the first ceramic substrate 110*a* and the second ceramic substrate 110*b* with a material having a dielectric constant higher than that of the substrate 10, and in addition, an overall dielectric constant of the chip antenna 100 may be lowered by providing a material having a dielectric constant lower than that of the first ceramic substrate 110*a*/the second ceramic substrate 110*b* between the first ceramic substrate 110*a* and the second ceramic substrate 110*b*. Therefore, radiation efficiency and gain may be improved.

FIGS. 7A through 7F illustrate an example of a method of manufacturing a chip antenna according to the second example.

Figure 7A:
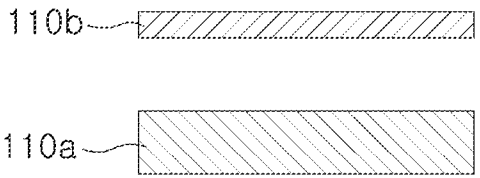
FIGS. 7A, 7B, 7C, 7D, 7E, and 7F illustrate an example of a method of manufacturing a chip antenna according to the second example.
Figure 7B:
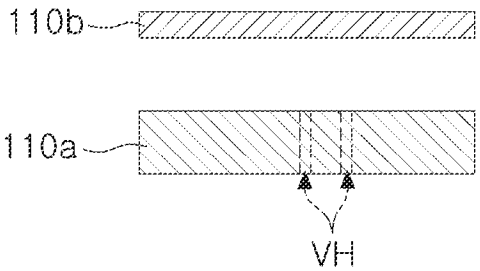
Figure 7C:
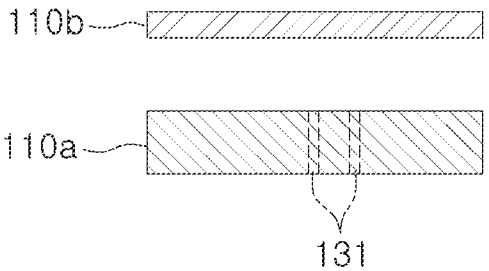

Referring to FIGS. 7A through 7F, a method of manufacturing a chip antenna according to an example starts with preparing a first ceramic substrate 110*a* and a second ceramic substrate 110*b* (see FIG. 7A). Subsequently, via holes VH are formed to penetrate through the first ceramic substrate 110*a* in a thickness direction (see FIG. 7B), and a conductive paste is applied to or filled in the via holes VH (FIG. 7C) to form feed vias 131. The conductive paste may be filled in the entire interior of the via holes, or may be applied to inner surfaces of the via holes VH to a predetermined thickness.

Figure 7D:
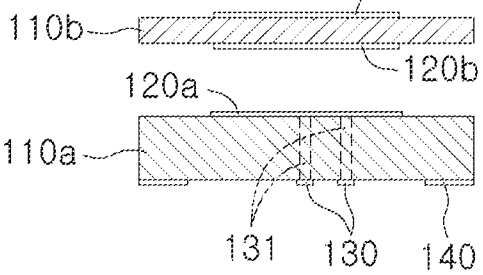

After the feed vias 131 are formed, a conductive paste or a conductive epoxy is printed and cured on the first ceramic substrate 110*a* and the second ceramic substrate 110*b* to form a first patch 120*a* on one surface of the first ceramic substrate 110*a*, form feed pads 130 and a bonding pad 140 on the other surface of the first ceramic substrate 110*a*, form a second patch 120*b* on the other surface of the second ceramic substrate 110*b*, and form a third patch 120*c* on one surface of the second ceramic substrate 110*b* (see FIG. 7D). Subsequently, a plating layer is formed on the first patch 120*a*, the second patch 120*b*, the third patch 120*c*, the feed pads 130, the feed vias 131, and the bonding pad 140 through a plating process. The plating layer may prevent oxidation of the first patch 120*a*, the second patch 120*b*, the third patch 120*c*, the feed pads 130, the feed vias 131, and the bonding pad 140.

Figure 7E:
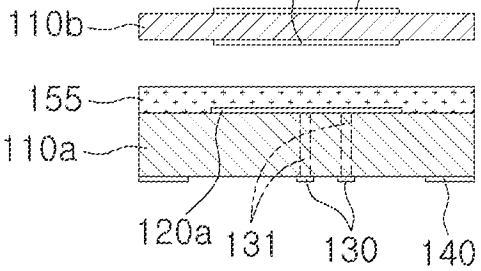
Figure 7F:
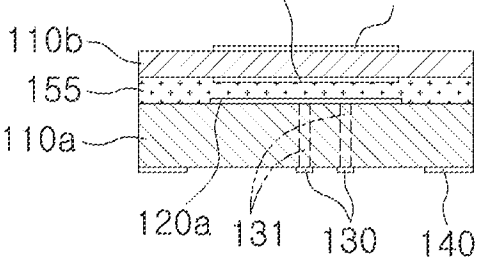

After forming the plating layer, a bonding layer 155 is formed to cover one surface of the first ceramic substrate 110*a* (FIG. 7E). After the bonding layer 155 is formed, the second ceramic substrate 110*b* and the first ceramic substrate 110*a* are compressed (FIG. 7F). After the bonding layer 155 is cured, a plurality of integrally-formed chip antennas is separated through a cutting process, thereby manufacturing individual chip antennas.

FIGS. 8A through 8E illustrate another example of the method of manufacturing a chip antenna according to the second example.

Figure 8A:
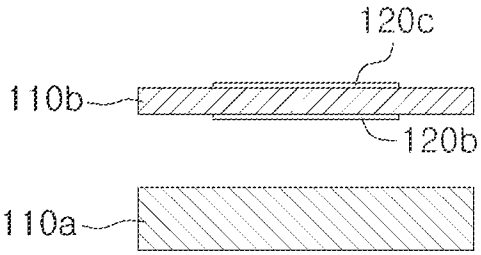
FIGS. 8A, 8B, 8C, 8D, and 8E illustrate another example of the method of manufacturing a chip antenna according to the second example.

Referring to FIGS. 8A through 8E, a first ceramic substrate 110*a* and a second ceramic substrate 110*b* are prepared, and a second patch 120*b* and a third patch 120*c* are formed on the second ceramic substrate 110*b* (see FIG. 8A). A conductive paste or a conductive epoxy is printed and cured on one surface and the other surface of the second ceramic substrate 110*b*, so that the second patch 120*b* is formed on the other surface of the second ceramic substrate 110*b*, and the third patch 120*c* is formed on one surface of the second ceramic substrate 110*b*.

Figure 8B:
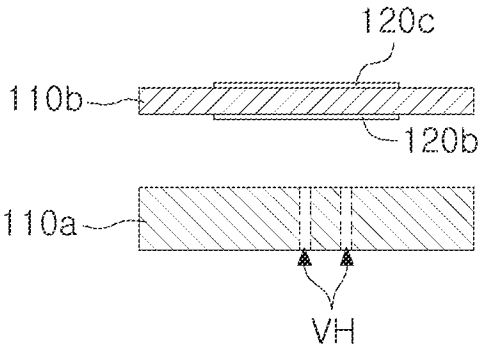

Next, via holes VH are formed to penetrate the first ceramic substrate 110*a* in a thickness direction (FIG. 8B). Via holes VH may be formed by a laser process or a mechanical drilling process.

Figure 8C:
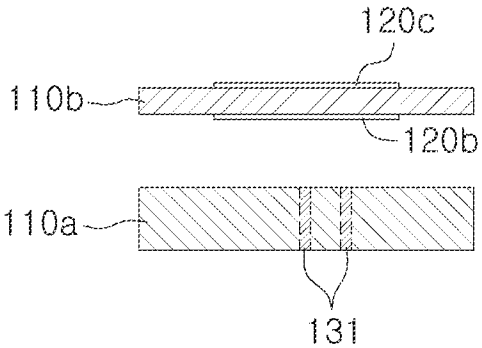

A conductive material such as a conductive paste is formed in the via holes VH to form feed vias 131 (FIG. 8C). The conductive material may be filled in the entire interior of the via holes, or may be applied to inner surfaces of the via holes to a predetermined thickness. The conductive material may be formed using a vacuum printing method such as fill-plating or paste filling.

Figure 8D:
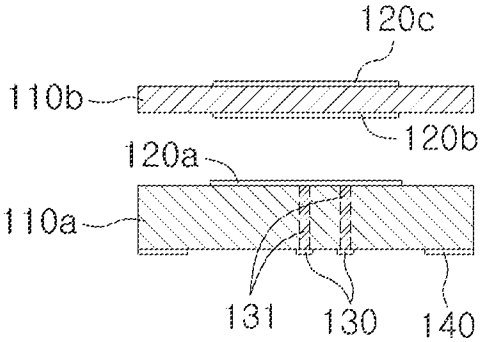

After the feed vias 131 are formed, a conductive paste or a conductive epoxy is printed and cured on the first ceramic substrate 110*a*, to form a first patch 120*a* on one surface of the first ceramic substrate 110*a* and form feed pads 130 and a bonding pad 140 on the other surface of the first ceramic substrate 110*a* (FIG. 8D). Subsequently, a plating layer is formed on the first patch 120*a*, the second patch 120*b*, the third patch 120*c*, the feed pads 130, the feed vias 131, and the bonding pad 140 through a plating process. The plating layer may prevent oxidation of the first patch 120*a*, the second patch 120*b*, the third patch 120*c*, the feed pads 130, the feed vias 131, and the bonding pad 140.

Figure 8E:
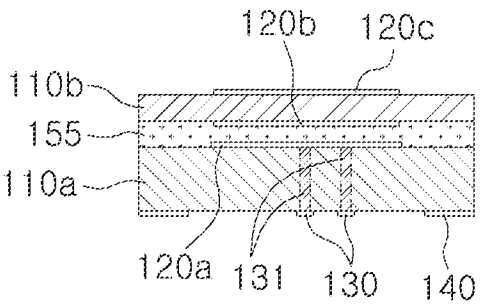

After the plating layer is formed, one surface of the first ceramic substrate 110*a* and the other surface of the second ceramic substrate 110*b* are bonded through a bonding layer 155 (FIG. 8E). After the bonding layer 155 is cured, a plurality of chip antenna arrays integrally formed are cut using a dicing method or a multi-wire saw (MWS) method to manufacture individual chip antennas.

Figure 9A:
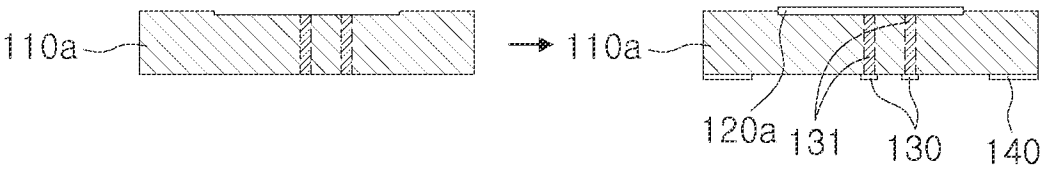
FIGS. 9A and 9B illustrate a detailed manufacturing process of a first patch, a second patch and a third patch of the method of manufacturing a chip antenna according to the example of FIGS. 8A to 8E.
Figure 9B:
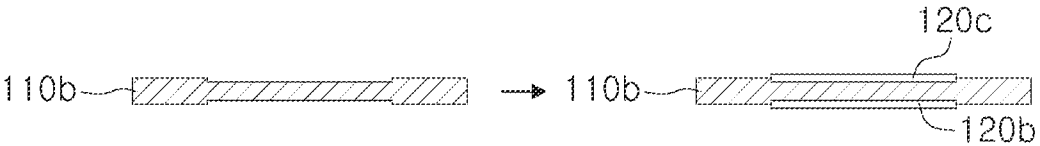

FIGS. 9A and 9B illustrate a detailed manufacturing process of the first patch, the second patch and the third patch, in the method of manufacturing a chip antenna according to the example of FIGS. 8A through 8E.

FIG. 9A illustrates a detailed manufacturing process of the first patch 120*a*, and FIG. 9B illustrates a detailed manufacturing process of the second patch 120*b* and the third patch 120*c*. In FIGS. 9A and 9B, the first patch 120*a* is disposed in a groove of the first ceramic substrate 110*a*, and the second patch 120*b* and the third patch 120*c* are disposed in grooves of the second ceramic substrate 110*b*. Thus, although all of the patches are illustrated to be disposed in the grooves, but according to examples, a portion of the first patch 120*a*, the second patch 120*b* and the third patch 120*c* may be disposed in a groove of the ceramic substrate, and the remaining patches may be disposed on a flat surface of the respective ceramic substrate.

As illustrated in FIGS. 8A through 8E, in a case in which the first patch 120*a*, the second patch 120*b* and the third patch 120*c* are disposed on the flat surfaces of the first ceramic substrate 110*a* and the second ceramic substrate 110*b*, the positions of portions of the first patch 120*a*, the second patch 120*b* and the third patch 120*c* may be deviated from the designed positions, resulting in a process error in which the alignment of the first patch 120*a*, the second patch 120*b* and the third patch 120*c* in the vertical direction is misaligned. In addition, a process error may occur in which the actual sizes of the first patch 120*a*, the second patch 120*b*, and the third patch 120*c* are different from the designed sizes.

In the method of manufacturing a chip antenna according to an example, grooves corresponding to the sizes and positions of the designed first patch 120*a*, the second patch 120*b*, and the third patch 120*c* may be formed in the first ceramic substrate 110*a* and the second ceramic substrate 110*b*, and a conductive paste or a conductive epoxy is printed and cured in the grooves to form the first patch 120*a*, the second patch 120*b*, and the third patch 120*c*. The grooves may be formed through a laser process with relatively high precision. A step is formed on the ceramic substrates by the grooves in the thickness direction.

A depth of the groove may be less than a thickness of the first patch 120*a*, the second patch 120*b*, and the third patch 120*c*, and in some examples, the depth of the groove may be the same as the thickness of the first patch 120*a*, the second patch and the third patch 120*c*.

When the depth of the groove is less than the thickness of the patch, the first patch 120*a*, the second patch 120*b*, and the third patch 120*c* may be formed to protrude from the groove.

When the depth of the groove is the same as the thickness of the first patch 120*a*, the second patch 120*b* and the third patch 120*c*, the first patch 120*a*, the second patch 120*b* and the third patch 120*c* may flatly compensate for a step formed in the ceramic substrate by the groove in the thickness direction. According to an example, in a situation in which the overall thickness of the chip antenna 100 is limited, the depth of the groove and the thicknesses of the first patch 120*a*, the second patch 120*b* and the third patch 120*c* may be designed to be the same as each other, thereby increasing space efficiency.

The sizes of the first patch 120*a*, the second patch 120*b* and the third patch 120*c* may be the same as the sizes of the grooves corresponding to the patches, respectively. Therefore, the first patch 120*a*, the second patch 120*b* and the third patch 120*c* may be provided in the entire areas formed by the grooves corresponding to the patches, respectively.

According to an example, the first patch 120*a*, the second patch 120*b*, and the third patch 120*c* are provided in the grooves formed with high precision, thereby effectively preventing the occurrence of a process error occurring in a case in which the first patch 120*a*, the second patch 120*b* and the third patch 120*c* are formed on one flat surface.

For example, a groove formed by laser processing may have a deviation of about 1% or less, whereas a patch provided on a ceramic substrate by a printing process or the like may have a deviation of about 5% or more. Patches disposed in the grooves of the ceramic substrates may be applied to chip antennas according to various examples.

According to an example, the first patch 120*a*, the second patch 120*b* and the third patch 120*c* are provided in the grooves, thereby effectively preventing the occurrence of a problem in which the first patch 120*a*, the second patch 120*b* and the third patch 120*c* are separated from the designed positions by external impacts.

The first ceramic substrate 110*a*, the second ceramic substrate 110*b*, the first patch 120*a*, the second patch 120*b*, the third patch 120*c*, the feed pads 130, the feed vias 131, and the bonding pad 140 of the chip antenna according to an example may be manufactured using low-tempered co-fired ceramic (LTCC) technology. The LTCC technology is a method of manufacturing a device using a ceramic dielectric in the form of a thick film (the thickness of tens to hundreds of micrometers) manufactured by tape casting and a conductive metal paste for implementing various circuit elements. In the case of the chip antenna according to an example, the first patch 120*a*, the second patch 120*b*, and the third patch 120*c* may be more accurately formed, using the LTCC technology.

FIGS. 10A through 10F illustrate another example of the method of manufacturing a chip antenna according to the second example.

Figure 10A:
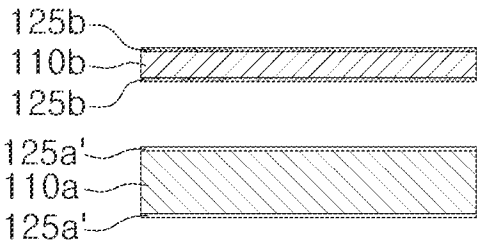
FIGS. 10A, 10B, 10C, 10D, 10E, and 10F illustrate another example of the method of manufacturing a chip antenna according to the second example.

Referring to FIGS. 10A through 10F, a first ceramic substrate 110*a* and a second ceramic substrate 110*b* are provided, a resin layer 125*a*' is formed on one surface and the other surface of the first ceramic substrate 110*a*, and an upper plate electrode 125*b* is formed by laminating a copper foil on one surface and the other surface of the second ceramic substrate 110*b* (see FIG. 10A). The resin layer 125*a*' is provided on the entire surface of the one surface of the first ceramic substrate 110*a* and the entire surface of the other surface of the first ceramic substrate 110*a*, and the upper plate electrode 125*b* is formed on the entire surface of the one surface of the second ceramic substrate 110*b* and the entire surface of the other surface of the second ceramic substrate 110*b*. The resin layer 125*a*' may include one of a polyimide film and a polyester film.

Figure 10B:
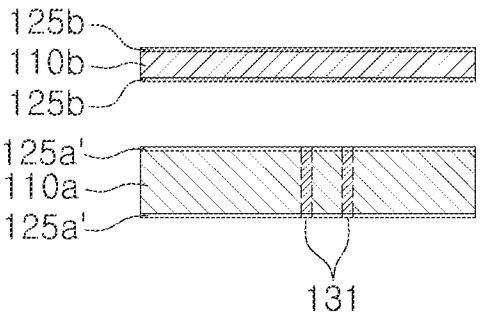
Figure 10C:
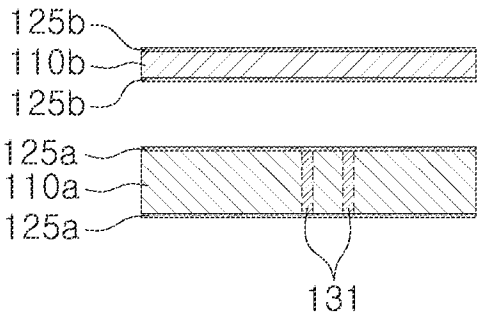
Figure 10D:
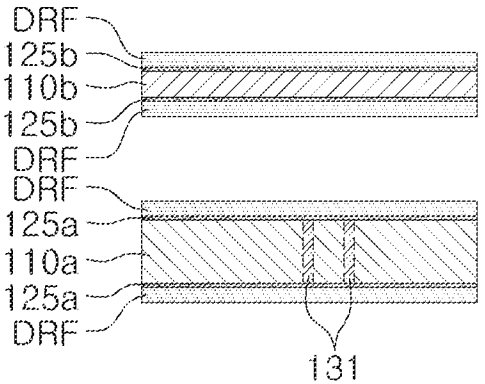
Figure 10E:
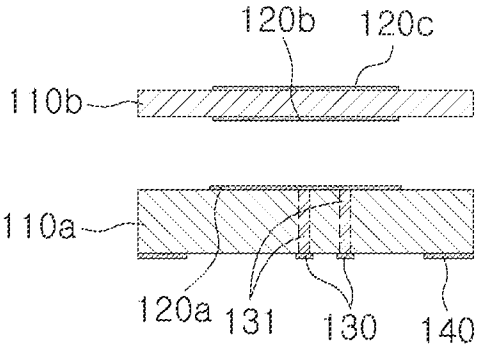

Feed vias 131 are formed by forming via holes penetrating through the first ceramic substrate 110*a* and the resin layer 125*a*' provided on the first ceramic substrate 110*a* in a thickness direction and forming a conductive material in the via hole (see FIG. 10B). The via holes may be formed by a laser process or a mechanical drilling process. The resin layer 125*a*' may protect the first ceramic substrate 110*a* from a laser process or a mechanical drilling process for forming a via hole. In addition to the first ceramic substrate 110*a*, the via holes penetrate through the thickness of the resin layer 125*a*' provided on the first ceramic substrate 110*a*. The via holes are formed to have a depth added by thicknesses of the resin layers 125*a*' provided on both surfaces of the first ceramic substrate 110*a*, and thus, the feed vias 131 manufactured based on the via holes may have a sufficient length. The conductive material may be filled in the entire interior of the via holes, or may be applied to have a predetermined thickness on the inner surfaces of the via holes. The conductive material may be formed using a vacuum printing method such as fill-plating or paste filling.

After the feed vias 131 are formed, the resin layer 125*a*' provided on both surfaces of the first ceramic substrate 110*a* is plated to form a lower plate electrode 125*a* (see FIG. 100). Subsequently, dry film photoresist (DFR) is laminated on the lower plate electrodes 125*a* provided on both surfaces of the first ceramic substrate 110*a* and the upper plate electrodes 125*b* provided on both surfaces of the second ceramic substrate 110*b* (see FIG. 10D).

The dry film photoresist (DFR) is exposed and developed depending on a designed pattern, and the lower plate electrodes 125*a* and the upper plate electrodes 125*b* exposed externally from the dry film photoresist (DFR) are etched. Thus, a first patch 120*a*, feed pads 130 and a bonding pad 140 are formed on the first ceramic substrate 110*a*, and a second patch 120*b* and a third patch 120*c* are formed on the second ceramic substrate 110*b* (see FIG. 10E). Thereafter, a plating layer may be formed on the first patch 120*a*, the second patch 120*b*, the third patch 120*c*, the feed pads 130, the feed vias 131, and the bonding pad 140 through a plating process.

Figure 10F:
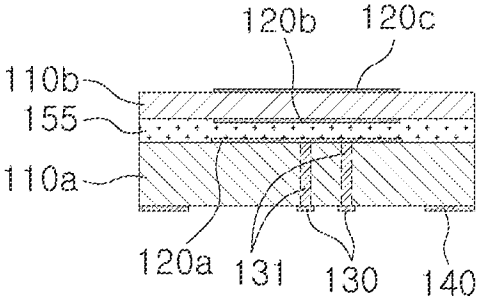

After the plating layer is formed, one surface of the first ceramic substrate 110*a* and the other surface of the second ceramic substrate 110*b* are bonded through a bonding layer 155 (see FIG. 10F). After the bonding layer 155 is cured, a plurality of chip antenna arrays integrally formed may be cut using a dicing method or a multi-wire saw (MWS) method to manufacture individual chip antennas.

Figure 11A:
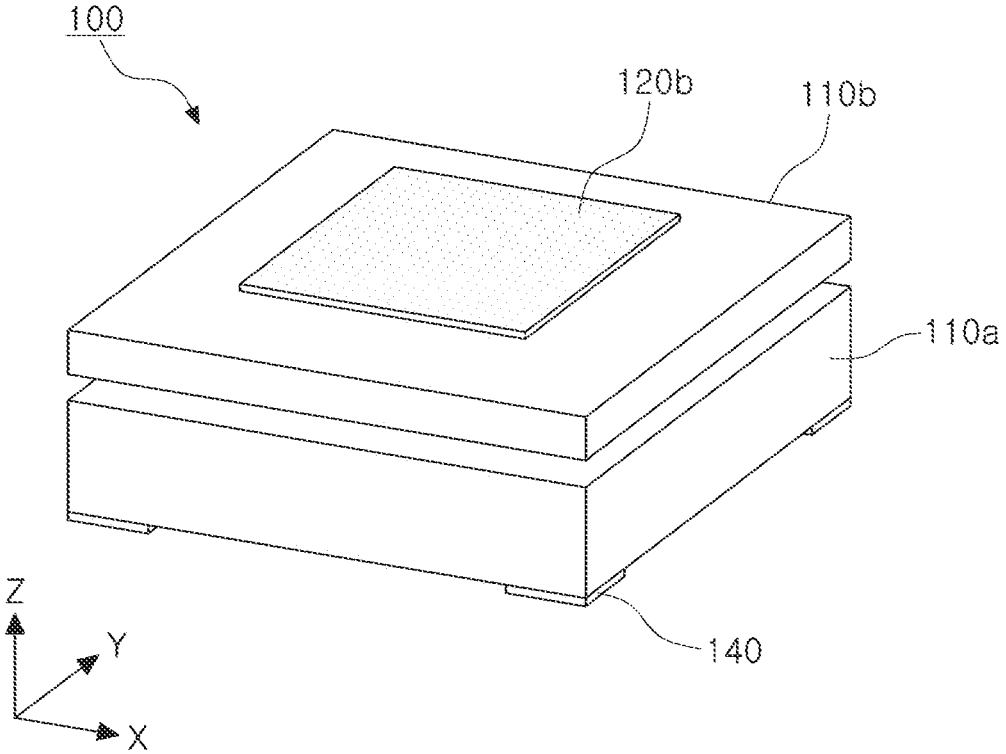
FIG. 11A is a perspective view of a chip antenna according to a third example.
Figure 11B:
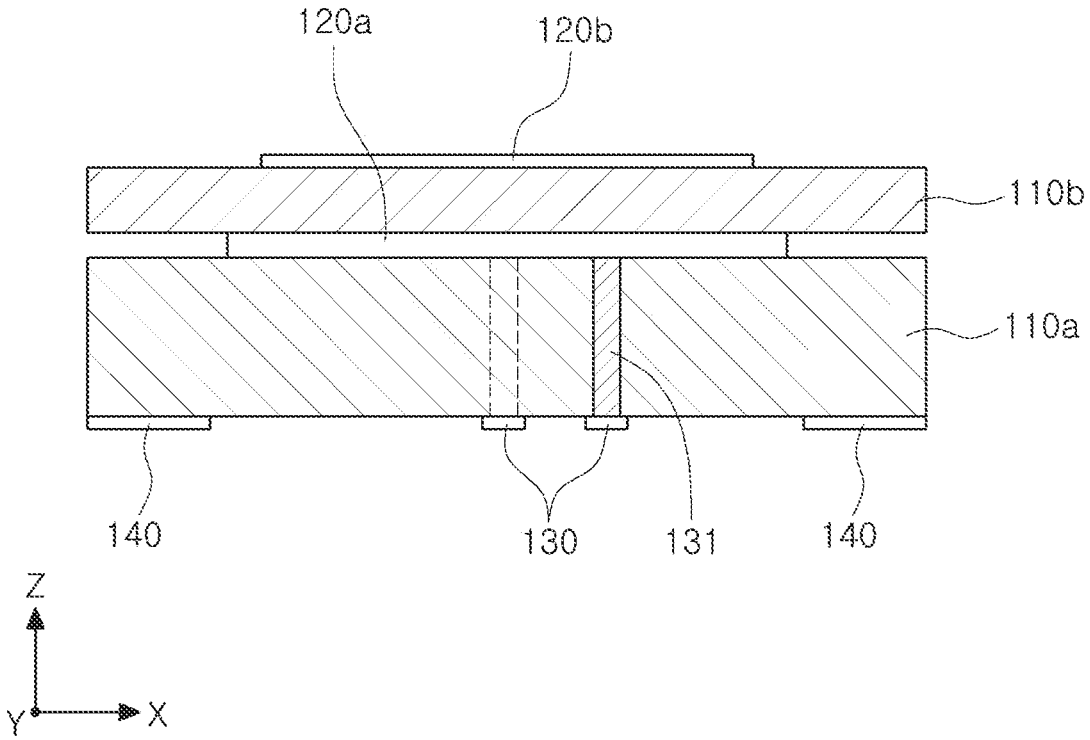
FIG. 11B is a cross-sectional view of the chip antenna of FIG. 11A.

FIG. 11A is a perspective view of a chip antenna according to a third example, and FIG. 11B is a cross-sectional view of the chip antenna of FIG. 11A. Since the chip antenna according to the third examples has some similarities to the chip antenna according to the first example, overlapping descriptions thereof will be omitted and will be provided based on differences.

The first ceramic substrate 110*a* and the second ceramic substrate 110*b* of the chip antenna 100 according to the first example are spaced apart from each other through the spacer 150, whereas a first ceramic substrate 110*a* and a second ceramic substrate 110*b* of a chip antenna 100 according to the third example may be bonded to each other with a first patch 120*a* therebetween.

For example, the first patch 120*a* is provided on one surface of the first ceramic substrate 110*a*, and a second patch 120*b* is provided on one surface of the second ceramic substrate 110*b*. The first patch 120*a* provided on one surface of the first ceramic substrate 110*a* may be bonded to the other surface of the second ceramic substrate 110*b*. Therefore, the first patch 120*a* may be interposed between the first ceramic substrate 110*a* and the second ceramic substrate 110*b*.

FIGS. 12A through 12E illustrate a method of manufacturing a chip antenna according to the third example.

Figure 12A:
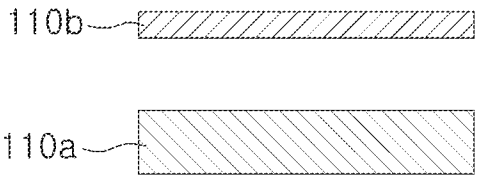
FIGS. 12A, 12B, 12C, 12D, and 12E illustrate a method of manufacturing a chip antenna according to a third example.
Figure 12B:
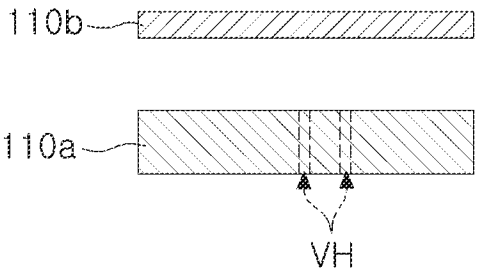
Figure 12C:
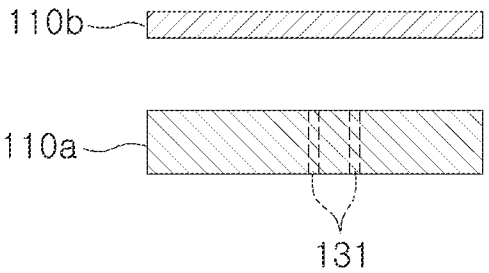

Referring to FIGS. 12A through 12E, a method of manufacturing a chip antenna according to an example starts with preparing a first ceramic substrate 110*a* and a second ceramic substrate 110*b* (see FIG. 12A). Subsequently, via holes VH are formed to penetrate through the first ceramic substrate 110*a* in a thickness direction (FIG. 12B), and a conductive paste is applied or filled in the via holes VH (FIG. 12C), to form feed vias 131. The conductive paste may be filled in the entire interior of the via holes VH, or may be applied to inner surfaces thereof to a predetermined thickness.

Figure 12D:
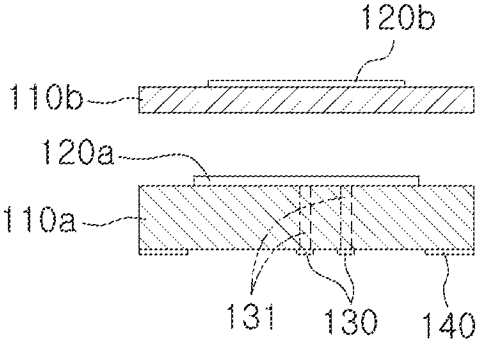
Figure 12E:
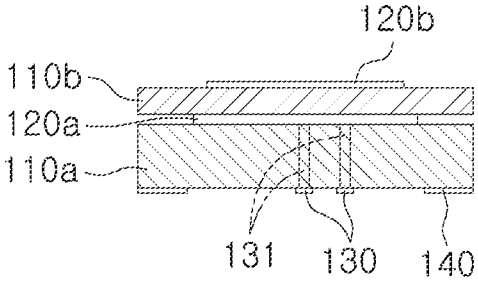

After the feed vias 131 are formed, a conductive paste or a conductive epoxy is printed and cured on the first ceramic substrate 110*a* and the second ceramic substrate 110*b*, to form a first patch 120*a* on one surface of the first ceramic substrate 110*a*, form feed pads 130 and a bonding pad 140 on the other surface of the first ceramic substrate 110*a* and form a second patch 120*b* on one surface of the second ceramic substrate 110*b*. (FIG. 12D). Subsequently, the conductive paste or the conductive epoxy is additionally printed one or more times in the area in which the first patch 120*a* is formed, and before the additionally printed conductive paste or conductive epoxy is cured, the second ceramic substrate 110*b* is pressed with the first patch 120*a* (see FIG. 12E). After the first patch 120*a* is cured, a plating layer is formed on the second patch 120*b*, the feed pads 130, the feed vias 131, and the bonding pad 140 through a plating process. The plating layer may prevent oxidation of the second patch 120*b*, the feed pads 130, the feed vias 131, and the bonding pad 140. Subsequently, a plurality of integrally-formed chip antennas is separated through a cutting process, thereby manufacturing individual chip antennas.

Figure 13:
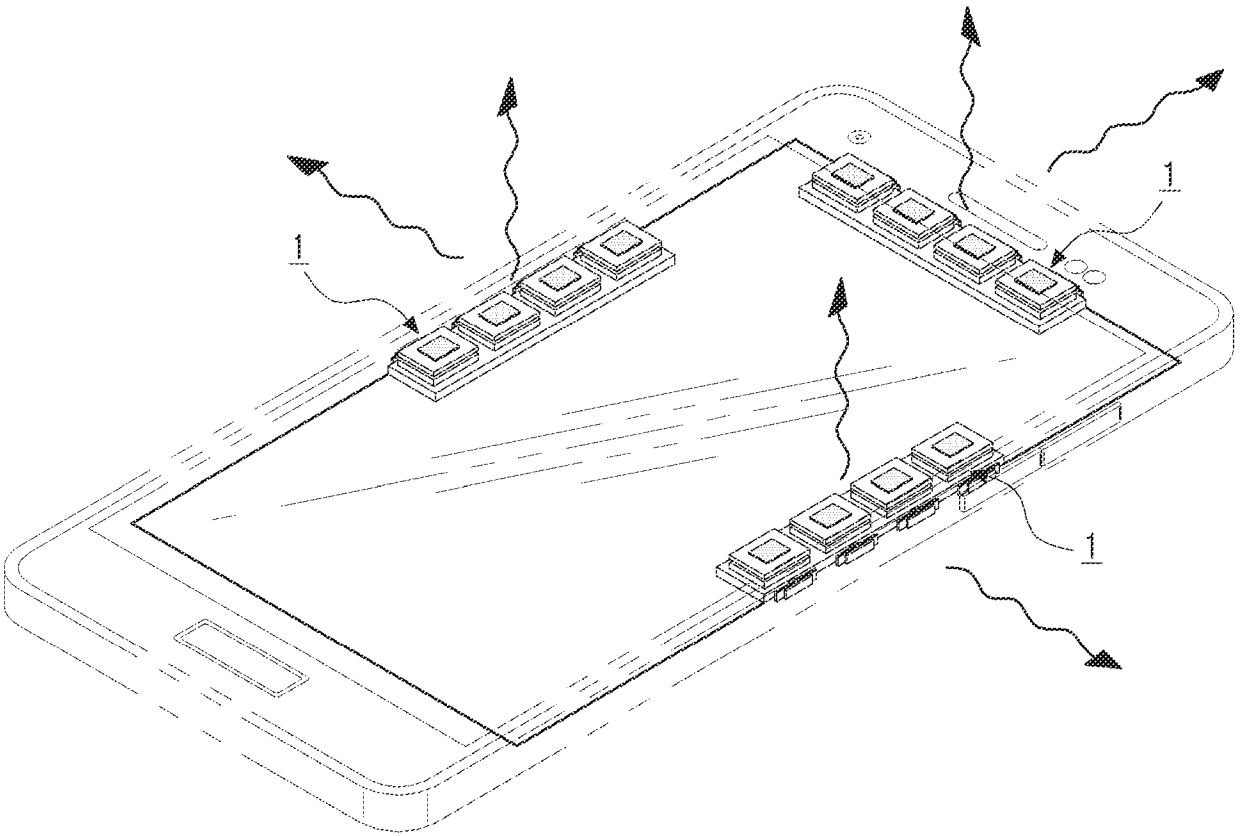
FIG. 13 is a schematic perspective view of a portable terminal equipped with a chip antenna module according to an example.

FIG. 13 is a perspective view schematically illustrating a portable terminal equipped with a chip antenna module according to an example.

Referring to FIG. 13, a chip antenna module 1 according to an example is disposed adjacent to an edge of a portable terminal. As an example, chip antenna modules 1 are disposed on sides of the portable terminal in a longitudinal direction or on sides thereof in a width direction, to face each other. In this example, the case in which the chip antenna modules are disposed on two sides of the portable terminal in the longitudinal directions and one widthwise side of the portable terminal is exemplified, but disclosure configuration is not limited thereto. The arrangement structure of the chip antenna module, such as the arrangement of only two chip antenna modules in a diagonal direction of the portable terminal, may be modified in various forms as necessary. An RF signal radiated through the chip antenna of the chip antenna module 1 radiates in the thickness direction of the mobile terminal, and an RF signal radiated through the end-fire antenna of the chip antenna module 1 radiates in directions perpendicular to sides of the portable terminal in the longitudinal direction or to the side thereof in the width direction.

As set forth above, in the chip antenna according to the example, the patch may be disposed in a groove formed with high precision, thereby effectively removing a process error.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna comprising:

a first ceramic substrate comprising a first surface, the first surface having a first groove;

a second ceramic substrate comprising a second surface disposed to face the first surface of the first ceramic substrate, the second surface having a second groove;

an interlayer disposed between the first ceramic substrate and the second ceramic substrate;

a first patch disposed in the first groove on the first surface of the first ceramic substrate and configured to operate as a feed patch; and a second patch disposed in the second groove on the second surface of the second ceramic substrate and configured to operate as a radiation patch, wherein a dielectric constant of the interlayer is less than a dielectric constant of the first ceramic substrate and a dielectric constant of the second ceramic substrate.

2. The chip antenna of claim 1, wherein the interlayer comprises spacers and air between the spacers.

3. The chip antenna of claim 2, wherein the spacers are disposed between corners of the first ceramic substrate and corners of the second ceramic substrate.

4. The chip antenna of claim 1, wherein the interlayer comprises a bonding layer disposed between the first ceramic substrate and the second ceramic substrate.

5. The chip antenna of claim 1, wherein the first patch has a first thickness greater than a depth of the first groove and the second patch has a second thickness greater than a depth of the second groove.

6. The chip antenna of claim 1, wherein the first patch is disposed in an entire area formed by the first groove and the second patch is disposed in an entire area formed by the second groove.

7. The chip antenna of claim 1, further comprising a third patch disposed on a third surface of the second ceramic substrate opposite the second surface of the second ceramic substrate.

8. The chip antenna of claim 7, wherein the third surface of the second ceramic substrate has a third grove and the third patch is disposed at the third grove.

9. A chip antenna comprising:

a first ceramic substrate comprising a first surface;

a second ceramic substrate comprising a second surface disposed to face the first surface of the first ceramic substrate;

an interlayer disposed between the first ceramic substrate and the second ceramic substrate;

a first patch disposed on the first ceramic substrate and to which a feed signal is applied; and a second patch disposed on the second ceramic substrate and coupled to the first patch, wherein the first surface of the first ceramic substrate comprises a first groove that forms a first step in a thickness direction, and wherein the second surface of the second ceramic substrate comprises a second groove that forms a second step in a thickness direction, the first patch is disposed in the first groove to fill the first step and the second patch is disposed in the second groove to fill the second step, and wherein a dielectric constant of the interlayer is less than a dielectric constant of the first ceramic substrate and a dielectric constant of the second ceramic substrate.

10. The chip antenna of claim 9, wherein the interlayer comprises spacers and air between the spacers.

11. The chip antenna of claim 10, wherein the spacers are disposed between corners of the first ceramic substrate and corners of the second ceramic substrate.

12. The chip antenna of claim 9, wherein the interlayer comprises a bonding layer disposed between the first ceramic substrate and the second ceramic substrate.

13. The chip antenna of claim 9, wherein a thickness of the second patch is equal to a depth of the second groove.

14. The chip antenna of claim 9, wherein the second patch is disposed in an entire area formed by the second groove.

* * * * *